US005504512A

United States Patent [19]

Shimoda et al.

[11] Patent Number: 5,504,512

[45] Date of Patent: Apr. 2, 1996

[54] INK JET RECORDING APPARATUS AND INK CARTRIDGE USABLE THEREWITH

[75] Inventors: Junji Shimoda, Chigasaki; Hideo Fukazawa, Yokohama; Koji Terasawa, Mitaka; Katsuyuki Yokoi, Yokohama; Makoto Takemura, Tokyo; Tetsuji Kurata, Yokohama; Koichiro Kawaguchi, Yokohama; Kazuhiko Shinoda, Yokohama, all of Japan

[73] Assignee: Canon Kabushiki Kaisha, Tokyo, Japan

[21] Appl. No.: 233,549

[22] Filed: Apr. 26, 1994

Related U.S. Application Data

[63] Continuation of Ser. No. 765,012, Sep. 24, 1991, abandoned.

[30] Foreign Application Priority Data

| | | | |
|---|---|---|---|
| Sep. 27, 1990 | [JP] | Japan | 2-255044 |
| Oct. 3, 1990 | [JP] | Japan | 2-266895 |
| Oct. 3, 1990 | [JP] | Japan | 2-267174 |

[51] Int. Cl.[6] ..... B41J 2/175

[52] U.S. Cl. ..... 347/86

[58] Field of Search ..... 347/85, 86, 49

[56] References Cited

U.S. PATENT DOCUMENTS

| | | | |
|---|---|---|---|
| 2,950,421 | 8/1960 | Langstroth | 317/99 |
| 4,313,124 | 1/1982 | Hara | 346/140 R |
| 4,345,262 | 8/1982 | Shirato et al. | 346/140 R |
| 4,419,678 | 12/1983 | Kasugayama et al. | 346/140 R |
| 4,429,320 | 1/1984 | Hattori et al. | 346/140 R |
| 4,447,820 | 5/1984 | Terasawa | 346/140 R |
| 4,459,600 | 7/1984 | Sato et al. | 346/140 R |
| 4,463,359 | 7/1984 | Ayata et al. | 346/1.1 |
| 4,542,385 | 9/1985 | Jinnai et al. | 346/75 |
| 4,558,333 | 12/1985 | Sugitani et al. | 346/140 R |
| 4,591,875 | 5/1986 | McCann | 346/75 |
| 4,695,851 | 9/1987 | Terasawa | 346/140 R |
| 4,719,475 | 1/1988 | Kiyohara et al. | 346/140 R |
| 4,723,129 | 2/1988 | Endo et al. | 346/1.1 |
| 4,737,801 | 4/1988 | Ichihashi et al. | 346/140 R |
| 4,740,796 | 4/1988 | Endo et al. | 346/1.1 |
| 4,882,597 | 11/1989 | Sugiyama | 346/140 R |
| 4,907,019 | 3/1990 | Stephens | 346/140 R |
| 4,939,528 | 7/1990 | Yamamoto et al. | 346/17 |
| 4,965,596 | 10/1990 | Nagashi et al. | 346/140 R |
| 4,970,533 | 11/1990 | Saito et al. | 346/140 R |
| 5,049,930 | 9/1991 | Okano et al. | 355/206 |
| 5,138,344 | 8/1992 | Ujita | 346/140 R |
| 5,168,291 | 12/1992 | Hiramatsu et al. | 346/140 R |
| 5,365,312 | 11/1994 | Hillmann et al. | 355/206 |

FOREIGN PATENT DOCUMENTS

| | | | |
|---|---|---|---|
| 90060241 | of 0000 | Australia . | |
| 117718 | 9/1984 | European Pat. Off. . | |
| 0339770 | 11/1989 | European Pat. Off. . | |
| 364284 | 4/1990 | European Pat. Off. . | |
| 0412459 | 2/1991 | European Pat. Off. . | |
| 3429073 | 2/1985 | Germany . | |
| 3405164 | 8/1985 | Germany | 347/86 |
| 54-056847 | 5/1979 | Japan . | |
| 59-123670 | 7/1984 | Japan . | |
| 59-138461 | 8/1984 | Japan . | |
| 0214656 | 12/1984 | Japan | 346/140 R |
| 60-071260 | 4/1985 | Japan . | |
| 0037954 | 2/1988 | Japan | 346/140 R |
| 37954 | 2/1988 | Japan | 347/86 |
| 1-141750 | 6/1989 | Japan . | |
| 8102062 | 7/1981 | WIPO . | |
| 8606032 | 10/1986 | WIPO . | |
| 8908028 | 9/1989 | WIPO . | |

*Primary Examiner*—N. V. Le

*Attorney, Agent, or Firm*—Fitzpatrick, Cella, Harper & Scinto

[57] ABSTRACT

An ink jet recording apparatus usable with an ink cartridge includes an ink cartridge mounting passage a plate for blocking the ink cartridge mounting passage and; a limiting member for preventing opening of the plate. The limiting member is disposed at each lateral end portion so that they are arranged in a chevron shape with an upward inclination, and when the ink cartridge is inserted in the ink cartridge passage, the limiting members contact to a front surface of the ink cartridge and are simultaneously rotated externally to release the blocking plate.

6 Claims, 16 Drawing Sheets

INK JET RECORDING APPARATUS AND INK CARTRIDGE USABLE THEREWITH

This application is a continuation of application Ser. No. 07/765,012 filed Sep. 24, 1991, now abandoned.

FIELD OF THE INVENTION AND RELATED ART

The present invention relates to an ink jet recording apparatus for effecting recording by depositing ink on a recording material and an ink cartridge usable with the recording apparatus, more particularly to these suitable for color recording.

An ink jet recording type is particularly noted, and many variations are developed. In the ink jet recording apparatus, the ink is ejected or projected from a recording means and is deposited imagewisely on a recording material. In one type of the recording apparatus, the ink is supplied from an ink cartridge which is separable from the recording means and which is detachably mounted on the recording apparatus, and in another type, the ink is supplied from an ink container which is integral with the recording means which in turn is detachably mountable on the recording apparatus. In the ink cartridge type, the ink supply passage is established by communication between an ink supply needle provided in the recording apparatus at an ink cartridge mounting portion and ink supply port of the ink cartridge.

In the case of the separate type ink cartridge, an operator's finger may be injured by the needle if the operator's finger accesses the ink cartridge mounting portion when the ink cartridge is to be replaced or when the ink cartridge is not mounted therein. In order to avoid this, a protection member is provided. FIG. 1 shows an example of such a protection member. A protection plate is disposed in the mounting portion for the ink cartridge IC for blocking the mounting passage. It is provided with a releasable locking mechanism. The protection plate is designated by a reference numeral 751 which is swingable about a supporting shaft 752. Locking members 753 function to prevent the swinging movement of the protection plate 751. When the ink cartridge IC is inserted in the direction indicated by an arrow A, a lock releasing member 754 provided at each lateral side of the cartridge pushes the locking member 753 in the direction indicated by an arrow D, thus releasing the locking member 753. By further pushing the ink cartridge IC with the released locking member 753, the protection plate 751 is pushed by the front side of the cartridge and is moved up, by which the mounting path is opened. So, the mounting of the cartridge IC is permitted. When the ink cartridge IC is pulled out, the locking member 753 which has been released is again brought into engagement with the protection plate 751, thus reestablishing the locked state to assure the mounting path closing state.

Recently, a color recording ink jet apparatus has been proposed. In order to effect the color recording, plural recording means and plural ink cartridges are needed to meet the number of colors.

An ink cartridge mounting system for each of the colors requires the above described protection mechanism. If, however, the above-described mechanism is employed, the overall mechanism becomes bulky, because the plural ink cartridges are arranged vertically or horizontally and because the mechanism requires a substantial width due to the lock releasing members at the lateral sides.

In the case of the color recording apparatus, the operator may try to replace plural ink cartridges simultaneously. If the ink cartridges are mounted in the erroneous positions, that is, to the mounting portion for a different color, the different color ink materials are mixed with the result of non-desired printing.

In addition, when the ink cartridge is mounted in place in the mounting portion, the communication between the ink supply needle and the ink supply port must be assuredly established. If proper mounting is not assured, air may be introduced into the ink supply passage with the result of improper recording.

It has been proposed the ink cartridge be provided with information representative of the characteristics of the ink or the like and that the information be read by the recording apparatus to accomplish optimum quality recording. In such a case, the information portion and the reading means must properly aligned with certainty, since otherwise the information can not be read or it may be erroneously read.

If the ink in the cartridge is completely used up, ink ejection failure is brought about. Therefore, the remaining quantity of the ink in the cartridge is required to be correctly detected. For this purpose, an indicator is used, or an electric resistance change is measured. In addition, the ink pressure may also be detected. Although the pressure detection type is relatively reliable, the structure is relatively complicated with the result of higher cost.

SUMMARY OF THE INVENTION

Accordingly, it is a principal object of the present invention to provide an ink jet recording apparatus and an ink cartridge usable therewith wherein the manipulation thereof is safe with a simple structure.

It is another object of the present invention to provide an ink jet recording apparatus and an ink cartridge usable therewith wherein the cartridge may be assuredly mounted in the recording apparatus.

It is a further object of the present invention to provide an ink jet recording apparatus and an ink cartridge usable therewith wherein the cartridge can be assuredly mounted in the recording apparatus so that the ink can be assuredly supplied to the recording apparatus.

It is a further object of the present invention to provide an ink jet recording apparatus and ink cartridges usable therewith wherein the apparatus and the cartridges are suitable for color recording and in which the cartridges can be mounted in the right positions of the recording apparatus.

According to an aspect of the present invention, there is provided an ink jet recording apparatus usable with an ink cartridge, comprising: an ink cartridge mounting passage; a plate for blocking said ink cartridge mounting passage; a limiting member for preventing opening of said plate; wherein said limiting member is disposed at each lateral end portion so that they are arranged in a chevron shape with upward inclination, and wherein when the ink cartridge is inserted in the ink cartridge passage, said limiting members are contacted to a front surface of said ink cartridge and are simultaneously rotated externally to release said blocking plate.

According to another aspect of the present invention, there is provided an ink jet recording apparatus, comprising: plural ink cartridges containing different ink materials, said ink cartridge including a cut-away portion peculiar to the ink material contained in said ink cartridge, an ink supply portion and an information providing portion for providing information peculiar to the ink in said ink cartridge; an index member engageable with said cut-away portion; an ink communicating means for communication with said ink supply portion; reading means for reading information from said information providing portion; and wherein engagement between said cut-away portion and said index member, communication between said ink communication means and said ink supply portion, contact between said information providing portion and said reading means, are started in the order named with mounting movement of said ink cartridge in said apparatus.

According to a further aspect of the present invention, there is provided an ink cartridge containing ink usable with a recording apparatus, comprising: a cut-away portion formed at a position peculiar to ink material contained therein; an ink supplying portion connectable with an ink supply connecting means in a recording apparatus; an information providing portion for providing information peculiar to the ink material contained therein; and wherein said cut-away portion, said ink supplying portion and said information providing means are started to be contacted or engaged with associated portions in said apparatus.

According to a further aspect of the present invention, there is provided an ink pressure detecting device, comprising: a passage member having an ink passage therein and an opening in communication with the ink passage; a diaphragm mounted on said passage member so as to cover the opening; at least two engaging members each having an engaging pawl, said engaging members being fixed adjacent a center of said diaphragm; a spring clamping ring; a compression spring compressed between said spring clamping ring and said diaphragm; contacts for being electrically connected with each other by said diaphragm urged by said spring.

According to the present invention, the locking member of the protection plate can be released by the front side of the cartridge, so that the size of the structure can be reduced.

According to another aspect of the present invention, indexes, ink supply connection means and reading means of the main assembly of the recording apparatus are assured in the alignment with the cut-away portion, the ink supply portion and the information part of the ink cartridge, so that the ink cartridge can be assuredly mounted.

According to a further aspect of the present invention, the cut-away portions are different depending on the colors of the ink, and the corresponding index members are different depending on the colors, and therefore, the ink cartridges can be mounted in right positions with certainty.

According to a yet further aspect of the present invention, the ink cartridge is provided with the information indicative of the recording head driving condition, under which the recording apparatus can be properly operated in accordance with the color and the properties of the ink material.

According to a further object of the present invention, the pressure of the ink can be properly detected.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, embodiments of the present invention will be described. The present invention is applicable to a monochromatic or color ink jet recording apparatus, but is particularly suitable for a printer using different ink materials having different color or having different densities (tones) in the same color. The following description will be made as to a color printer.

Figure 2A:
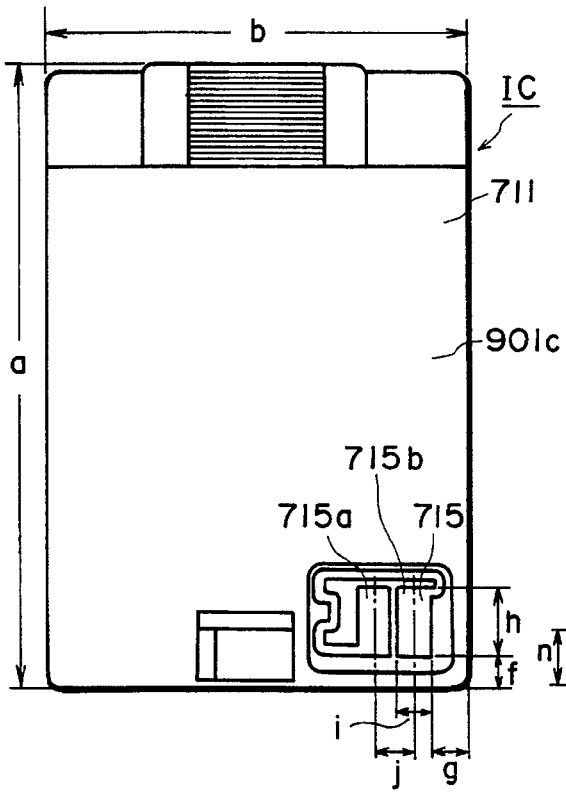
FIGS. 2A, 2B and 2C are a top plan view, a bottom plan view and a front view of an example of an ink cartridge according to an embodiment of the present invention.
Figure 2B:
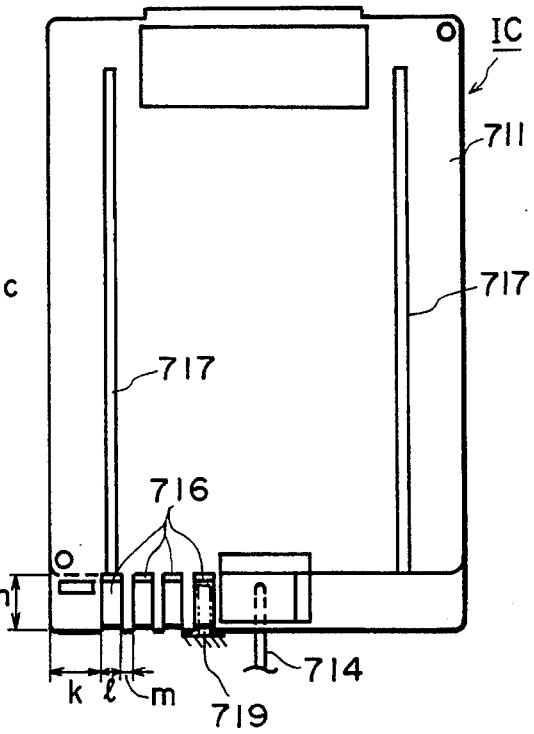
Figure 2C:
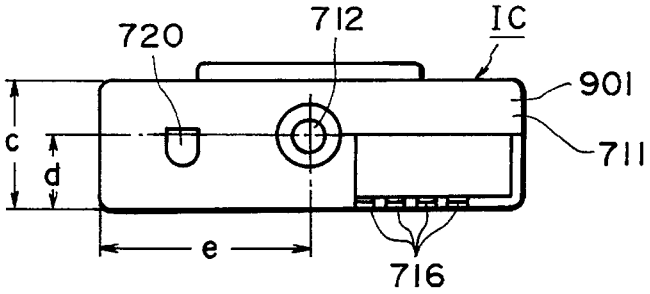

FIGS. 2A, 2B and 2C show an ink cartridge usable with a color printer, according to an embodiment of the present invention. As shown in the Figure, an ink cartridge IC includes a casing 711 having a length a of 108 mm, a width b of 75 mm and a height c of 22 mm. It contains an ink bladder (not shown) of a flexible material to contain ink therein. An ink supply port is closed by a rubber plug (ink supply member) 712. When the ink cartridge IC is inserted into the ink cartridge mounting portion of the main assembly of the recording apparatus, an ink supply needle 714 of the main assembly pierces the rubber plug 712, so that the ink in the bladder is supplied to a recording head through a supply passage. As shown in FIG. 2C, the rubber plug 712 is exposed at an outer surface of the casing 711, and the center thereof is at a position having a height d of 12.4 mm, a distance e of 37 mm from a lateral side, for example. In this example, the rubber plug 712 is approximately 3 mm away from the front surface of the ink cartridge IC. By placing it so, even if the surface of the rubber plug 712 is contaminated with the ink, the operator's finger is not contaminated.

Around the rubber plug 712, a ring may be mounted to maintain the compression of the rubber plug 712, thus preventing the ink from leaking even when the needle is removed. The rigid ring may be disposed flush with the front surface of the casing, and the edge thereof may be folded back to the inside. With this structure, a groove is formed between the rubber plug 712 and the rigid ring, and therefore, even if the ink is leaked, it is trapped by the groove, so that the leakage is prevented.

As shown in FIG. 2A, the top surface of the ink cartridge IC is provided with a resistor 715 having a predetermined resistance. It comprises a pair of contacts each having a height h of 12 mm, a width i of 6 mm and a pitch j of 7 mm. One corner thereof is placed at a position 6 mm (f) away from a reading end 6 mm (g) away from a side surface on the top surface 901*c* of the ink cartridge IC. The reading means 718 of the apparatus reads whether the electric connection is established between the contacts 715*a* and 715*b* of the resistor 715 or the resistance between the contacts. Thus, the presence or absence of the ink cartridge IC in the apparatus or the ink information (color, density, contents or the like) is supplied to the apparatus to drive the recording head in accordance with the property of the ink.

The information member may be in another form such as optical or magnetical bar codes, semiconductor (electrically erasable read only semiconductor memory array EEPROM or a read only memory ROM battery back up RAM), pit and projection pattern or the like. The head driving conditions or parameters may be set to be suitable for the used ink using a predetermined conversion table.

The driving conditions to be set include a driving voltage, a pulse width, a driving frequency, the number of preliminary ejections or the like. All of them may be selected or only one of them, such as the driving voltage only, pulse width only, driving frequency only. Otherwise, some of them may be selected in combination.

The information medium of the ink cartridge may provide the condition or conditions for the preliminary heating to improve the ink properly by heating the recording head, an ink ejecting condition or conditions to provide optimum ink ejection during the recording. In the case of the plural ink materials having different colors used, the information may include the above described ejecting conditions or the like for the respective ink materials.

On the bottom side of the ink cartridge IC and at a position opposite from the resistor 715, as shown in FIG. 2B, there is formed a cut-away portion 716 having a predetermined configuration. The cut-away portion 716 is disposed at a position inherent to the color of the ink. By provision of index members 719 in the main assembly, the correct loading of the ink cartridge IC is assured. The cut-away portion 716 is formed in a range between a position 9 mm (k) away from a side surface of the cartridge toward the ink supply portion 714 and a position before the ink supplying portion 712. In this example, the cut-away portion 716 has a width of 13.5 mm, a length of 9 mm (n). Four cut-away portions can be formed in the range at the intervals of 2 mm (m). For example, an ink cartridge IC (901BK) containing the black ink has a cut-away portion at a position closest to the side surface; a cyan ink cartridge IC (901C) has the cut-away portion adjacent thereto; a magenta ink cartridge IC (901M) has the cut-away portion adjacent to the cyan ink indicative cut-away portion; and an yellow ink cartridge IC (90Y) has the cut-away portion 716 closest to the ink supply portion. The apparatus is provided with the corresponding index members 719, so that the ink cartridge IC is loaded in the right position.

The structures for assuring the loading at the correct positions include a projection on the ink cartridge and a recess on the main assembly.

In the case of the cut-away portions in the ink cartridges, the cut-away portions may be formed by an ink filling apparatus equipped with a cutter for providing the cut-away portion. Then, the cut-away portions may be formed simultaneously with the ink supply.

In another example, the cut-away portion is formed before the ink is supplied, and the ink supplying apparatus has an index in conformity with the cut-away portion, so that only correct color ink can be supplied.

With these methods of ink supply, the relation between the cut-away portion and the color of the ink in the ink cartridge is assured, as compared with the case in which the cut-away portion is formed after the ink cartridge is filled with the ink.

The ink cartridge IC is provided with two guides 717 so as to facilitate the loading of the ink cartridge IC into the apparatus, to provide a clearance from the bottom surface of the mounting portion of the apparatus, thus making it difficult to contaminate the bottom surface of the ink even if the ink is leaked in advertently. Then, the contamination does not expand on the bottom surface of the apparatus.

The ink cartridge IC has a residual ink collecting port 720 for collecting the residual ink not used for the recording, at a position adjacent to the ink supplying portion 712. The collected ink is introduced into the residual ink absorber below the ink bladder in the ink cartridge. Between the residual ink absorbing material and the bottom of the ink cartridge, a thin plastic resin sheet may be provided. Then, the capillary action between the sheet member and the ink cartridge is effective to distribute the collected residual ink to the entirety of the absorbing material from the peripheral area in the ink cartridge, thus the absorbing material away from the collecting port 720 can accommodate the ink.

Figure 3A:
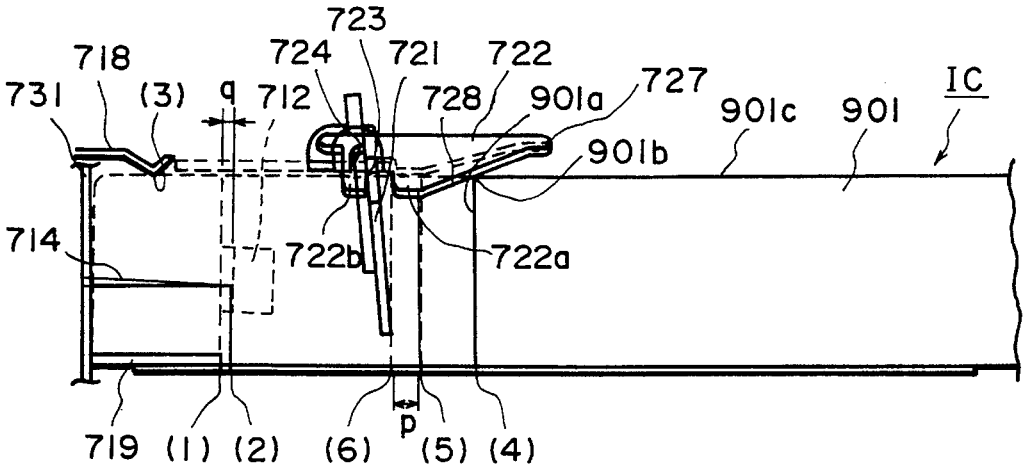
FIGS. 3A, 3B and 3C are a side view, a front view and a top plan view of an ink jet cartridge mounting portion of an ink jet recording apparatus according to an embodiment of the present invention.
Figure 3B:
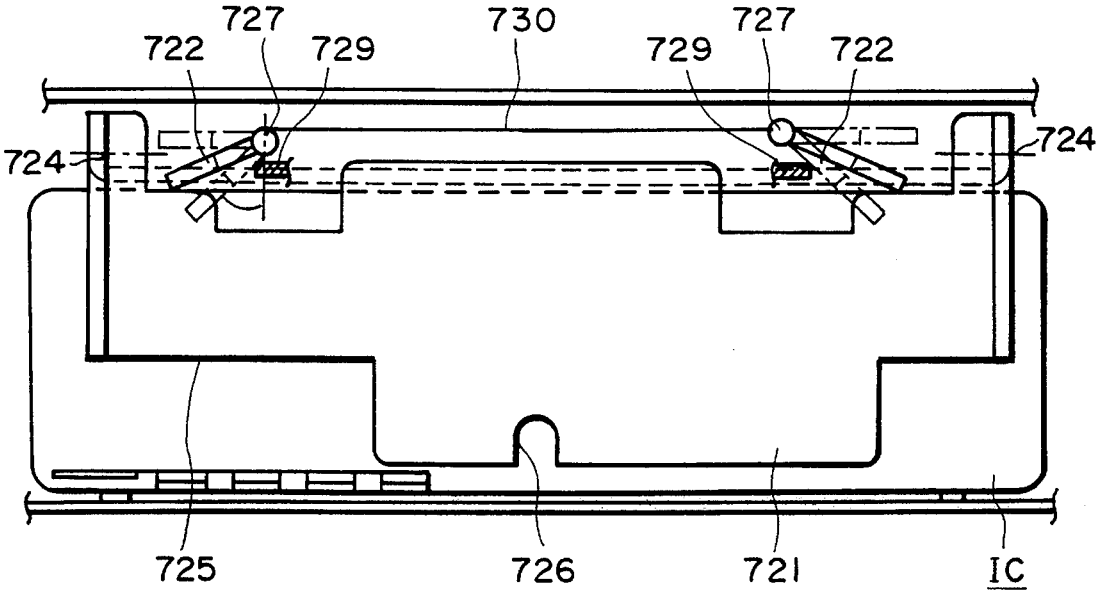
Figure 3C:
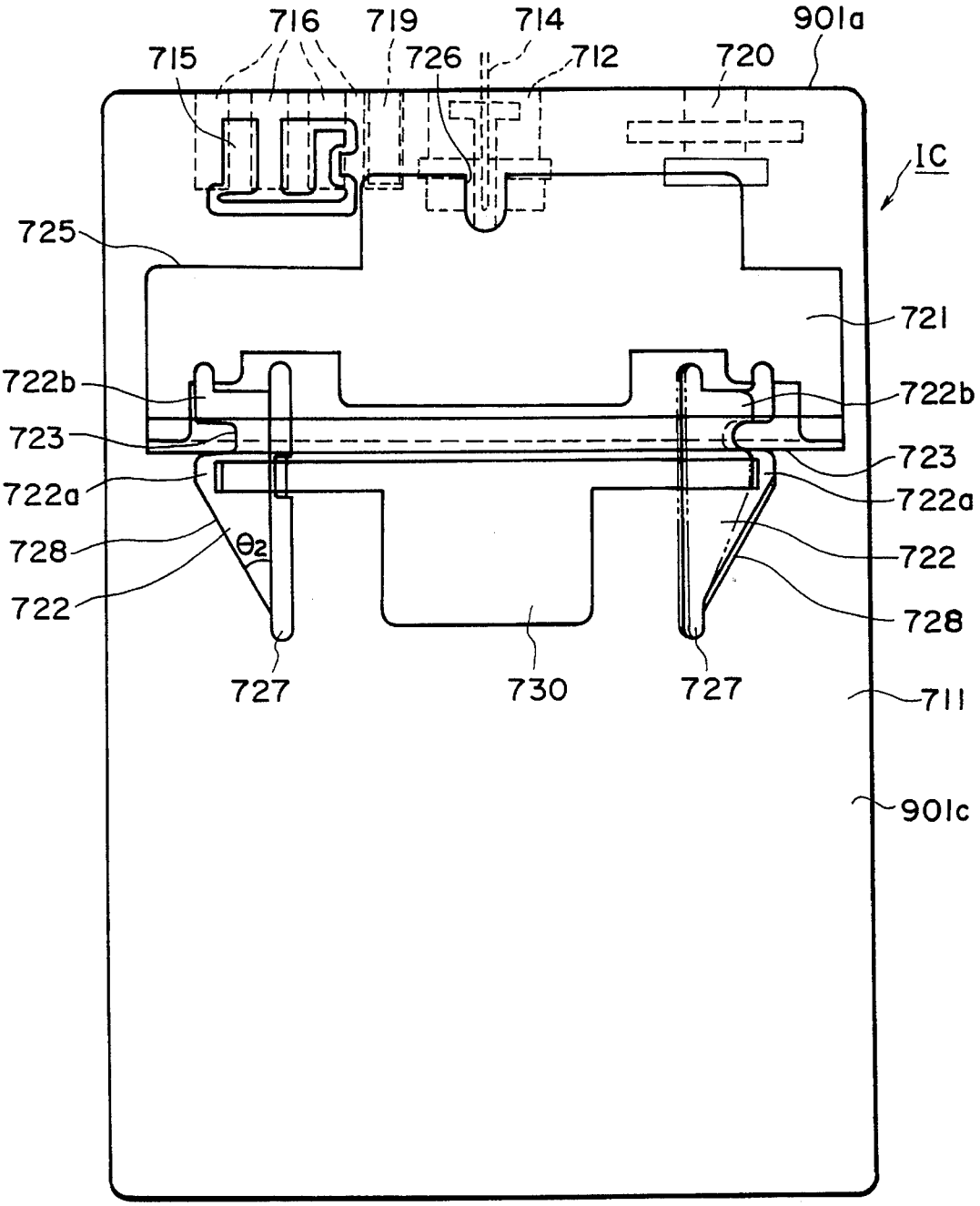

FIGS. 3A, 3B and 3C show the structure of the ink cartridge mounting portion of the main assembly of the recording apparatus. In the ink cartridge mounting path of the ink mounting portion, a plate 721 and a limiting member 722. The plate 721 is openable and closable and has an area substantially equal to the cross-sectional area of the ink cartridge, and the limiting member 722 functions to limit the opening of the plate 721. The plate 721 functions as a protection member for preventing an operator's finger from being injured by the ink supplying needle 714 when the ink cartridge IC is not mounted or when plural ink cartridges IC are simultaneously exchanged.

When the ink cartridge is not loaded, the plate 721, as shown in FIG. 3A, is not permitted to open by the engagement between a cut-away portion 723 in the regulating member 722 with a part of the plate 721.

The plate 721 has a rectangular configuration and is rotatable about a pivot 724. Within the rotational range thereof, there is no interfering member, that is, it is kept away from contacting the ink supply needle 714 or the resistance detecting member 718. To accomplish this, a certain part or parts may be cut away to avoid the interference. By cutting a portion away in this manner, the positions of the pivot 724, the ink supply needle 714 and the reading member 718 may be close to each other, so that the size of the apparatus can be reduced. In this embodiment, as shown in FIG. 3B, cut-away portions 725 and 726 are formed to avoid the interference between the plate 721 and the ink supply needle 714 and between the plate 721 and the resistance detecting member 718. Two of the limiting members 722 are provided above the plate 721 to prevent the opening motion of the plate 721. Each of them has a tapered portion 728 contactable to an upper edge portion 901*b* of the ink cartridge IC at its front surface 901*a*. By the inserting movement of the ink cartridge IC, it rotates outwardly about a pivot 727 thereof. It is inclined about a first angle of 45 degrees relative to the vertical direction. The tapered surface 728 is inclined about 30 degrees (θ2) in this embodiment relative to the inserting direction. These exemplary angles of the limiting member 722 are fairly important to accomplish the smooth insertion of the ink cartridge IC. The first angle is necessary to convert the ink cartridge pushing force to the force in the direction of pushing the limiting member 722 (outward). The angle may be any value if it provides a sufficient vector component to push the limiting member 722 outwardly. If the angle is not less than about 45 degrees, the limiting member 722 may be outwardly pushed with certainty by small force applied to the ink cartridge for the insertion.

The angle θ2 of the tapered portion 728 of the limiting member 722 is effective to cooperate with the first angle to convert the ink cartridge insertion force to the outward force to the limiting member 722. The angle θ2 may be any value if it accomplishes the above-described object. It, however, is practically not more than 45 degrees, further preferably about 30 degrees.

The first angle of the limiting member 721 is adjusted by a stopper 729 as shown in FIG. 3B. The limiting member 722 is normally urged upwardly by a leaf spring 730 so as to properly limit the plate 721 when the ink cartridge IC is retracted.

The limiting members 722 constitute a chevron with the above-described angles. When the ink cartridge IC is inserted, it is contacted by a part 901*b* of the front side of the ink cartridge IC. With further insertion of the ink cartridge IC, the limiting members 722 are substantially simultaneously rotated outwardly about the respective pivots 727, by which the plate 721 is released from the limitation.

It is preferable that the limiting member 722 is disposed at such a position that it does not contact the resistor 715 on the top surface 901*c* of the ink cartridge IC.

The portions of the limiting member 722 before and after the cut-away portion 723 have substantially the same lengths. As shown in FIG. 3A, a front part 722*a* of the limiting member 722 is contacted to an edge 901*b* of the ink cartridge IC at a position indicated by (4), and thereafter, it advances while pushing the limiting member 722. It is preferable that when the limiting member 722 is completely raised (5), the rear part 722*b* releases the plate 721. By employing such a positional relationship that after the limiting member 722 completely releases the plate 721, the front surface 901*a* of the ink cartridge is brought into contact with the plate 721 at the position indicated by (6). Then, the locking to the plate 721 is smoothly released. The deviation between the position (5) and the position (6) may be small (p), it is in this example approximately 2–3 mm, although it is not so limiting.

When the ink cartridge IC is further inserted with the path therefore opened, the ink supply port 712 of the ink cartridge IC is brought into communication with the ink supply means 714 of the main assembly of the apparatus, by which the ink supply to the recording head is enabled.

As shown in FIG. 3A and 3B, the periphery of the ink supply means 714 of the main assembly is provided with a projection 719 engageable with the cut-away portion 716 of the ink cartridge provided for preventing the erroneous insertion and a reading member 718 for reading the resistance provided for discrimination of the presence or absence of the ink cartridge IC in the apparatus.

It is preferable that the erroneous loading preventing index 719, the ink supply connecting means 714 and the reading means 718 have the following positional relations with the cut-away portion 716 of the ink cartridge IC, the ink supply portion 712 and the resistor 715: an engagement starting position (1) between the cut-away portion 716 and the index member 716, a communication starting position (2) between the ink supplying portion 712 and the ink supply communication means 714 and a contact starting position (3) between the resistor and the reading means 718, come in this order in the direction of the ink cartridge insertion. With this positional relations, when the operator inserts the ink cartridge IC, the contact or the engagement starts at the position (1) (FIG. 3A) between the cut-away portion 716 in the front surface 901*a* of the ink cartridge at a position inherent to the ink color and the index 719. Then, the discrimination is possible as to whether the ink cartridge IC is loaded at the correct position therefor. With only a simple structure of combination between the cut-away portion 716 of the ink cartridge and a projection 719 engageable with the cut-away portion 716, the ink cartridge can not be further inserted after abutment to the projection 719, if the ink cartridge IC is loaded at the wrong position. It can be further inserted only when the engagement relation is established therebetween. This is particularly effective when the color recording is capable in the recording apparatus. In the color recording, the recording heads are peculiar to the respective colors. By enabling the discrimination whether the ink cartridge IC is inserted at the correct position before the connection with the ink supplying portion 712 is established, undesirable ink mixture can be prevented beforehand.

When the cut-away portion 716 is engageable with the index member 719, the connection is established between the ink supply connecting means 714 of the main assembly and the ink supplying portion 716 of the ink cartridge so as to permit ink supply from the ink cartridge IC, at the position (2). After the establishment, the ink cartridge IC is further inserted by which the ink supplying needle 712 is brought into communication with the ink in the ink cartridge. In this example, the ink supply needle 712 projects approximately 12 mm, and the index member 719 is projected to the position of approximately 10 mm. However, since the ink supplying portion of the ink cartridge IC is disposed approximately 3 mm away from the front surface 901*a* (position (q)), the contact relation is maintained even if the ink supplying needle 712 is longer than the index member 719.

If the contact position between the ink supply needle 714 and the ink supply member 712 and the contact position between the cut-away portion 716 and the index member 719 satisfy the relation described above, the erroneous loading of the ink cartridge is assuredly prevented so that the possibility of ink mixture is avoided. However, the ink supply needle 714 and the ink supplying portion 712 may start communication therebetween if the ink supply needle 714 is practically away from contact with the ink in the ink cartridge. Therefore, the position (2) where the ink supply needle 714 is brought into communication with the ink is next to the contact starting position between the cut-away portion 716 and the index member 719.

After the establishment of the ink connection, contact starts between the information presenting member 715 in the form of a resistor for presenting the information representing the property of the ink cartridge IC and the reading means 718 in the form of the contacts for discrimination of the presence or absence of the cartridge IC. Upon the contact therebetween, the ink supply communicating means 714 of the apparatus is brought into communication with the ink in the cartridge. The loading of the ink cartridge is completed if after the connection with the reading means 718, the ink cartridge is further inserted until the front surface 901*a* of the ink cartridge is abutted to a wall 731 of the ink cartridge mounting portion of the apparatus. The abutment may be established at the position (3) shown in this Figure. However, in order to assure the contact between the resistance 715 and the contacts 718, they are preferably rubbed with each other after the start of the contact therebetween. By assuring the positional relation between the ink cartridge IC and the ink cartridge mounting portion, the correct loading of the ink cartridge IC is assured, so that an assured ink supply can be accomplished.

When the positional relation is not satisfied, the proper ink supply to the recording head will not be assured, or the stabilized supply will not be assured.

Referring to FIG. 14, another structure for preventing the erroneous loading will be described. In this embodiment, a pin (projection) 721A is provided on a side of a safety cover 721. The ink cartridge is provided with a groove 750 permitting passage of the pin.

The projection 721A is disposed at a position peculiar to the color, for example, at a position $l_1$ away from a side of the cover, and the groove 750 of the ink cartridge is disposed at a position peculiar to the color, for example, $l_2$ away from the side of the cartridge. In the case of the same ink color, the projection of the safety cover and the groove of the ink cartridge are aligned ($l_1=l_2$), and therefore, they are properly engaged, and the loading of the ink cartridge is permitted. However, if the ink cartridge is loaded in the wrong position, the projection of the safety cover and the groove of the ink cartridge is not aligned ($l_1 \neq l_2$), and therefore, the projection abuts the outer casing at the front side to prevent the further insertion of the cartridge. Therefore, the erroneous loading can be prevented. In addition, if the cartridge is inserted into the erroneous mounting portion, the insertion stops halfway, and therefore, the operator can easily recognize the erroneous position. The erroneous mounting can be discriminated at a position fairly away from the ink supply needle as compared with the foregoing embodiment, and therefore, the safety is further assured. In addition, the projection 721A is effective to guide the insertion of the cartridge, and therefore, the operativity is improved with the advantage of the proper alignment of the ink supply needle.

Figure 4:
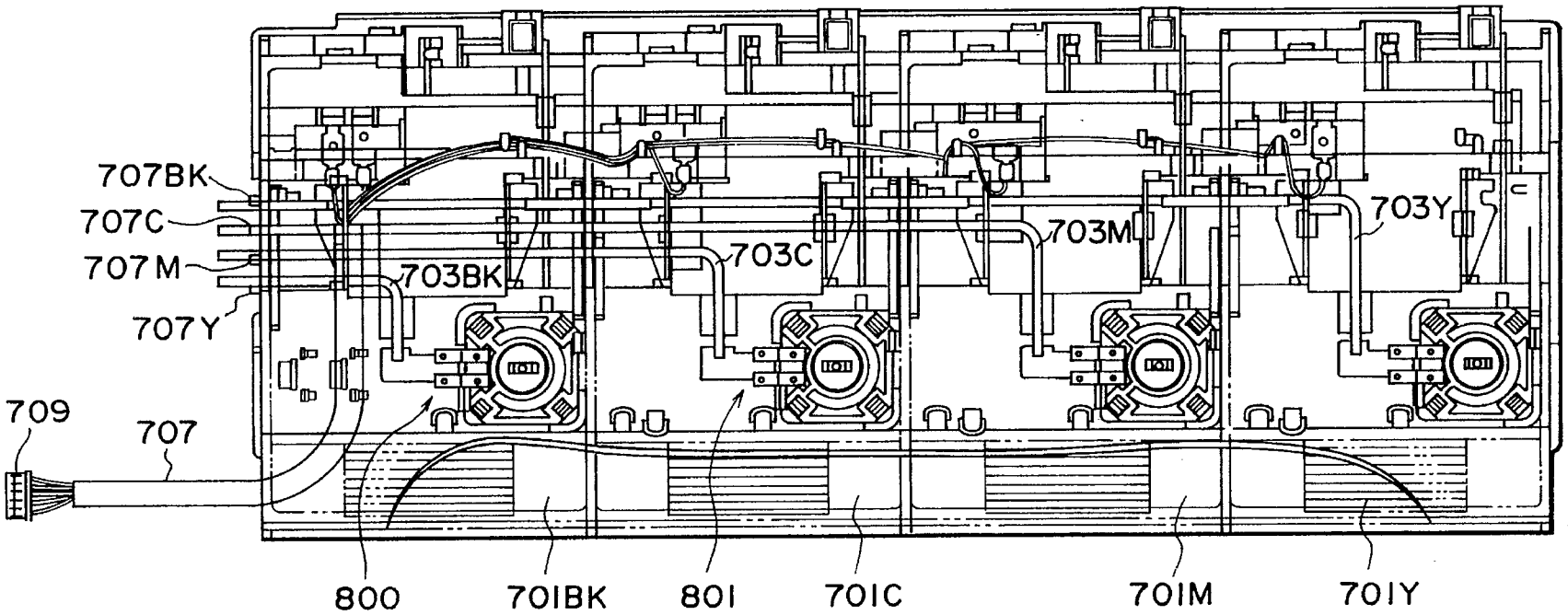
FIG. 4 is a top plan view of an ink container accommodator for illustrating arrangement of the ink containers.

Referring to FIG. 4, the description will be made as to the mechanism for detecting the remaining amount of the ink in the ink container. FIG. 4 is a top plan view of the ink container. An ink container 701 (701BK, 701C, 701M and 701Y) is in the form of a cartridge having an ink containing portion functioning as an ink supply source and a residual ink accommodator. The ink cartridge is detachably mountable to the main assembly of the recording apparatus. An ink supply pipe 703 (703BK, 703C, 703M and 703Y) is connected to an ink containing portion of the ink container. A residual ink pipe 707 (707BK, 707C, 707M and 707Y) functions to establish communication between the pump 440 and the residual ink accommodator in the ink container.

In this embodiment, the particular attention is paid to the following, regarding the ink container arrangement.

The solidifying nature and the viscosity increasing nature of the ink is different if the color is different, because of the composition thereof. For example, the viscosity increase and the solidification are easier in the order of black, cyan, magenta and yellow. The viscosity increase and the solidification occurs in the ink supply system which is a closed system. In this example, the supply pipe is of polyethylene tube. Irrespective of the material of the supply pipe, a small quantity of the air is introduced through the pipe wall, and the ink solvent evaporates. Therefore, the quantity of the air introduced and the evaporation quantity of the ink solvent increase with the increase of the length of the supply pipe.

In consideration of the above, the supply pipes are extended all in the same direction (left side in the Figure), and the ink containers are arranged from the side to which the ink is supplied, in the order of the easiness of the viscosity increase and solidification. In other words, the easier the viscosity increase or solidification, the shorter the pipe length (in the Figure, the black, cyan, magenta and the yellow containers are arranged in the order named from the left). By doing so, the introduction of the air and the evaporation of the solvent are smaller if the viscosity increase and solidification is easier. The same applies to the residual ink collecting system.

An ink remaining amount detecting device 800 is disposed between the ink containing portion of the ink container 701 and the ink supply pipe 703. A cable 707 contains various wiring required for the detecting device 800 and for detection of the presence or absence of the ink container, and designated by a reference numeral 709 is a connector therefor.

Figure 5A:
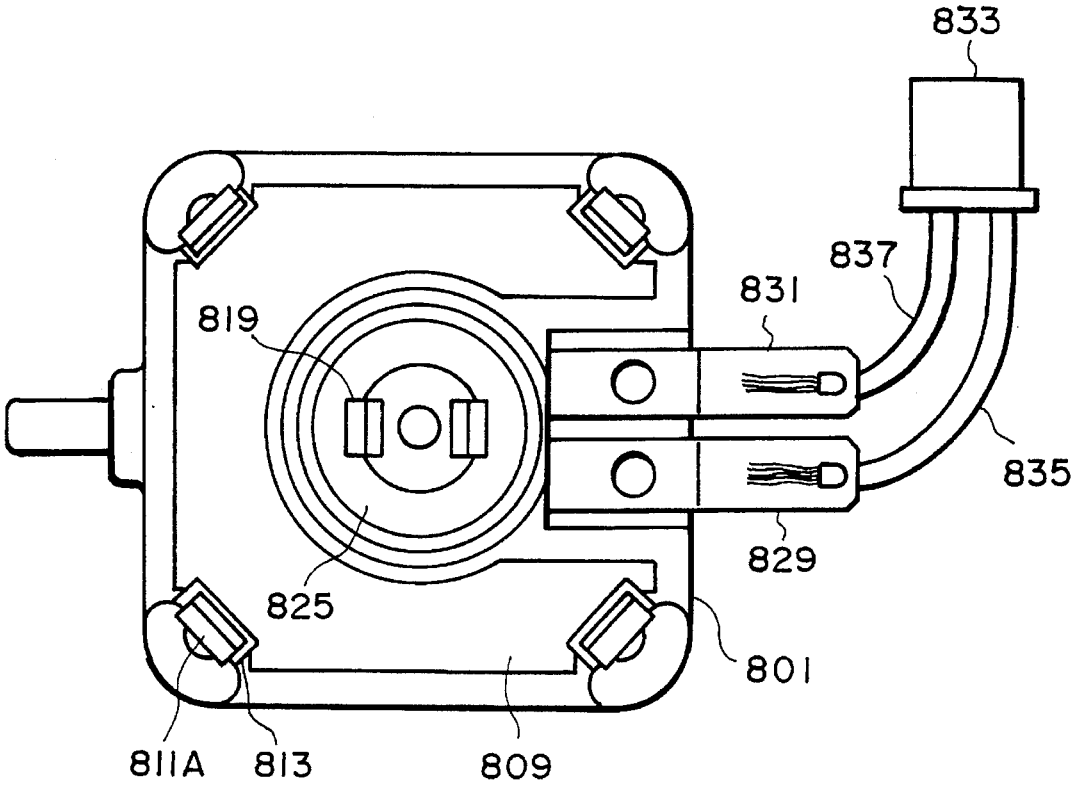
FIGS. 5A and 5B are a top plan view and a longitudinal sectional view of an example of an ink pressure detecting device used in this embodiment.
Figure 5B:
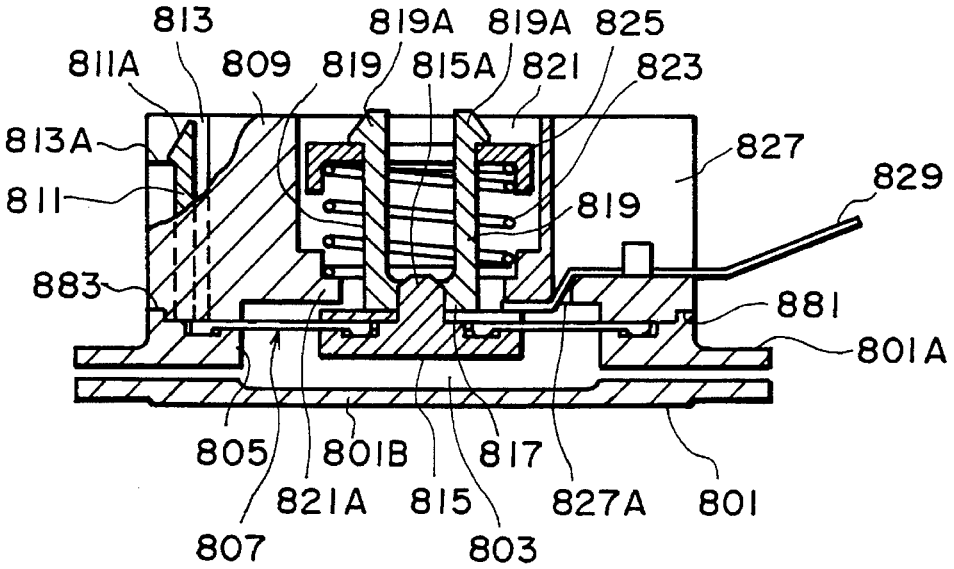

FIG. 5A is a top plan view of an ink pressure detecting device, and FIG. 5B is a longitudinal view thereof. An ink passage member 801 has an inside ink passage 803 and is constitute by a top member 801A and a bottom member 801B. The top member 801A has a circular opening 805. A ring diaphragm 807 is sandwiched at its periphery by the top member 801A and a confining member 809 and covers a peripheral area of the opening 805. At the four corners of the top member 801A, standing stopping members 811 are disposed, and at the four corners of the confining member 809, vertical through holes 813 are formed. At the upper outside portion of the holes 813, steps 813A are formed. The clamping member 811 has resiliency, and the outside of its end has an engaging pawl 811A. The engaging pawl 811A has a slanted top surface.

In the through hole 813 of the confining member 809, the clamping member 811 is disposed. By the engagement of the engaging pawl 811A with the step 813A, the confining member 809 is fixed to the top member 801A, so that the diaphragm 807 is sandwiched between the top member 801A and the confining member 809. The top peripheral surface of the top member 801A has a projection 881, and the bottom surface of the confining member 809 has a cut-away portion 883 at a position corresponding to the projection 881. By the engagement therebetween, the confining member 809 is positioned and fixed to the top member 801A.

To the central portion of the diaphragm 807, a supporting member 815 is mounted so as to close the inside opening. A base portion of an engaging member 817 is fixed by screw or the like to the supporting member 815 so that it is engaged with the projection (at the center of the opening 805) 815A at the top side of the center of the supporting member 815. The engaging member 817 has two standing engaging portions 819 having resiliency. Each of the engaging portion 819 has an engaging pawl 819A at the outside of the end thereof. The top surface of the engaging pawl 819A is slanted. The two engaging portions 819 are disposed at diametrically opposite positions about the center of the opening 805.

In the center of the confining member 809, a vertical through hole 821 is formed. The two engaging portions 819 are disposed in the through hole 821. In the holes 821, a coil spring 823 and a spring clamping ring 825 are disposed. The spring 823 is supported on a bottom ring projection (spring receptor) of the hole 821 outside the two engaging portions 819. The spring clamping ring 825 is engaged with the engaging pawl 819A of the engaging portion 819 at its inside. With this state, the top end of the spring 823 is lowered. The spring 823 is compressed by them (the annular projection 821A and the spring confining ring 825). Therefore, by the repelling force of the spring 823 (if the pressure of the ink in the ink passage 803 is neglected), the diaphragm 807 and the supporting member 815 are urged upwardly so that the top peripheral portion of the supporting member 815 is brought into contact to the bottom surface of the annular projection 821A.

A cut-away portion 827 is formed at a side of the confining member 809, and to the bottom of the cut-away portion 827. The central portions of a pair of conductive contacts 829 and 831 are fixed. One end of each of the contacts 829 and 831 is contacted to the bottom surface of the annular projection 821A through a hole 827A formed in the bottom of the cut-away portion 827, and to the other end, leads 835 and 837 extending from the connector 833 are connected to establish electric connection with an ink remaining amount detecting electric circuit. Bottom surfaces of the contacts 829 and 831 are urged to the top peripheral portion (electrically conductive) of the supporting member 815 by the repelling force provided by the spring 823, and they are electrically connected.

The pressure detecting device described above, can be easily assembled in the following manner. The diaphragm 807 is placed on the opening 805 of the passage member 801, and the confining member 809 is lowered from above the passage member 801 so that the clamping members 811 are aligned with the four corner holes 813. The slanted surface at the top of the engaging pawl 811A of the clamping member 811 abuts an inside edge of the hole 813, and by being pressed thereby, the clamping member 811 is inclined toward inside. It enters the hole 813 (that is, the confining member 809 lowers). While the confining member 809 confines the diaphragm 807 at its top, the engaging pawl 811A of the clamping member 811 acts by its resilient force on the step 813A (restoring), and is engaged. Thus, the confining member is positioned and fixed to the top member 801A.

Then, the spring 823 is introduced into the hole 821, and the bottom end thereof is placed on the annular projection 821A. Then, the spring clamping ring 825 is placed on the two engaging portions 819 and is pressed down. By doing so, the slanted top surfaces of the engaging pawls 819A of the engaging portions 819 are pressed by the inside edge of the spring clamping ring 825. The two engaging portions 819 are inclined by the resiliency toward inside, and the spring clamping ring 825 lowers. Then, the two engaging portions 819 are inclined again the outside by their resiliency, and therefore, the two engaging pawls 819A are engaged to the top inside surface of the spring clamping ring 825. In this manner, the spring clamping ring 825 is connected with the two engaging portions 819. The spring 823 is compressed by the spring clamping ring 825 and the annular projection 821A. The contacts 829 and 831 are mounted on the confining member 809 beforehand.

With this structure, the distance between the spring clamping ring 825 and the annular projection 821A is constant, and therefore, the compression force (repelling force) of the spring 823 is within a predetermined range. Therefore, the diaphragm 807 is responsive to the vacuum in the ink passage 803 within a predetermined range so that the supporting member 815 releases the contact members 829 and 831.

Figure 7:
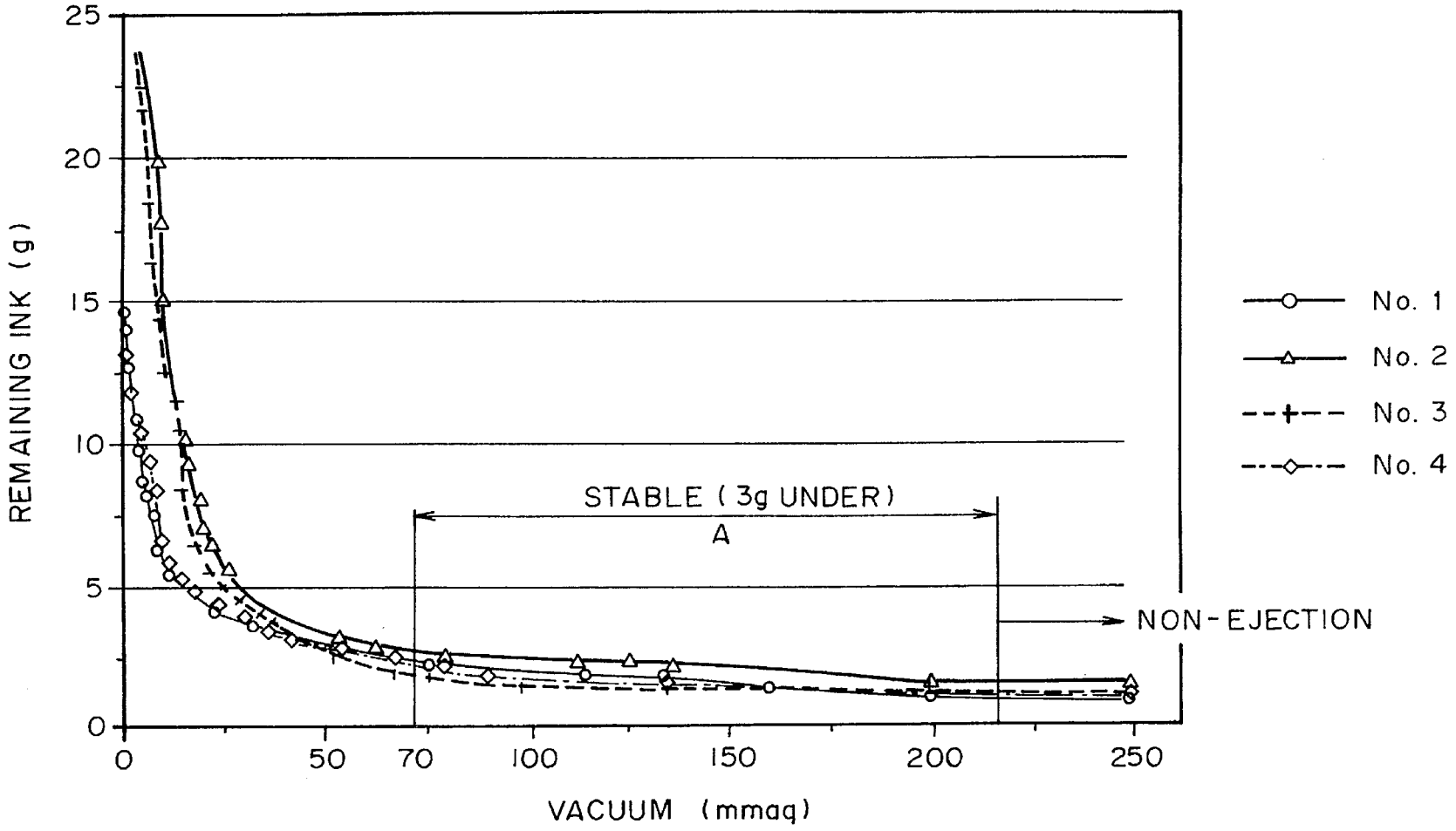
FIG. 7 is a graph showing a relation between a remaining quantity of the ink and a vacuum in an ink passage.

Accordingly, in the ink pressure detecting device of this embodiment, the pressure detected is within the range in which the ink remaining amount is stabilized, as shown by an arrow A in FIG. 7, without adjustment.

Figure 6B:
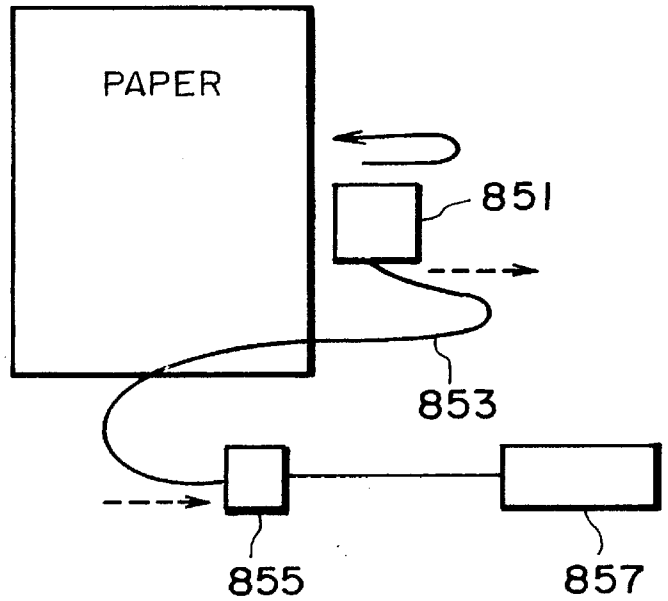
FIGS. 6A and 6B schematically shows pressure change in accordance with operation of a carriage.
Figure 6A:
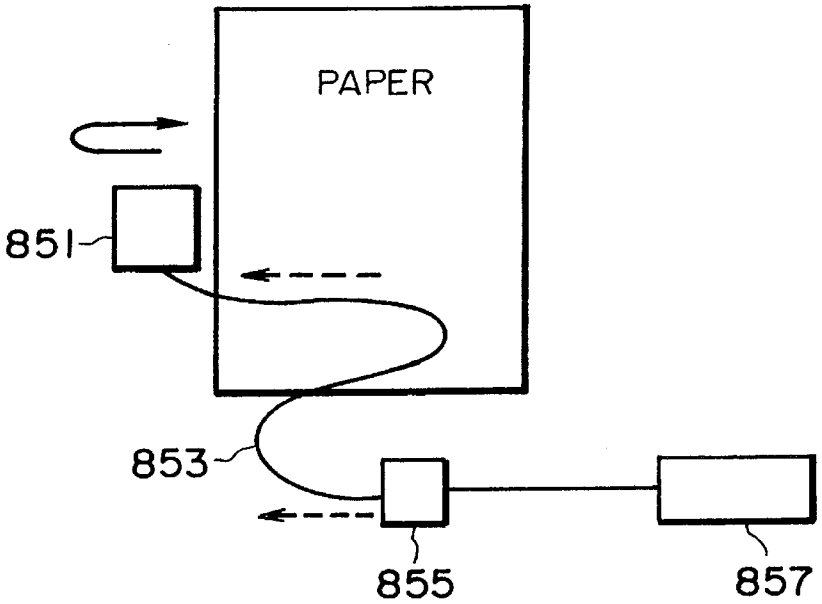

Normally, the ink pressure in the ink passage is detected by the ink sensor while the carriage is at rest or the carriage is moving (that is, except for the carriage return period). This will be described in conjunction with FIGS. 6A and 6B. When the carriage 851 is returning toward left or right, the ink in the ink passage 853 receives inertia force in the direction indicated by an arrow. This is influential because it applies additional vacuum pressure during the leftward return period, and it adds a pressure during the right return period. Thus, the correct remaining amount of the ink in the ink cartridge 857 is detected by the ink sensor 855.

Figure 8A:
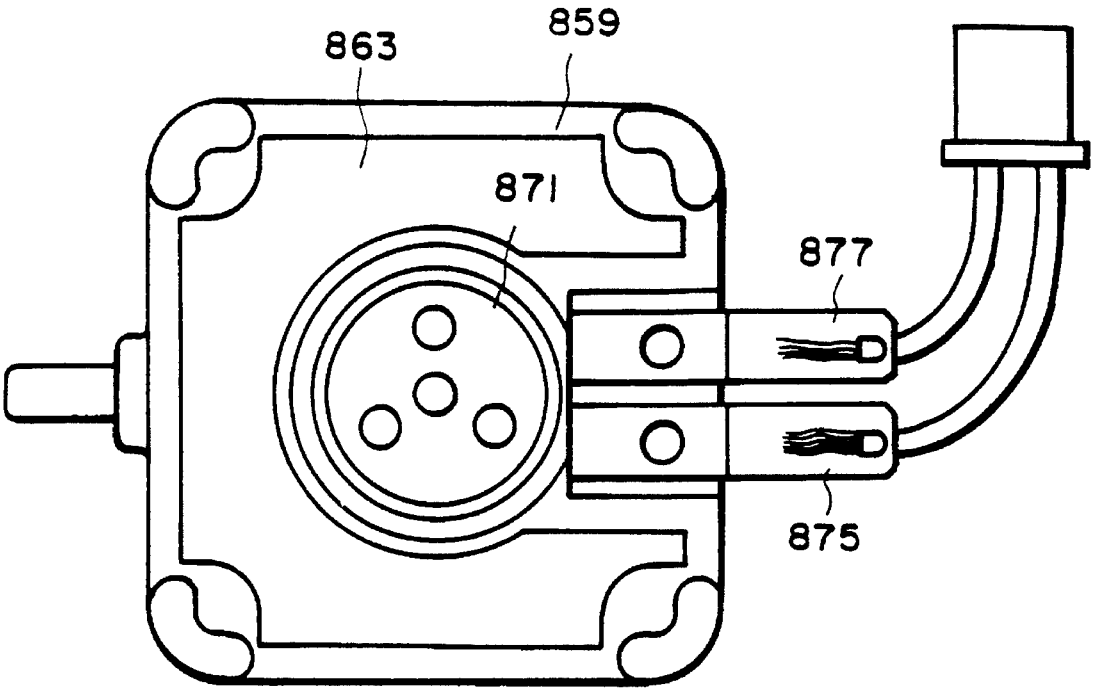
FIG. 8A PRIOR ART
FIGS. 8A and 8B are a top plan view and a longitudinal sectional view of a conventional ink pressure detecting device.
Figure 8B:
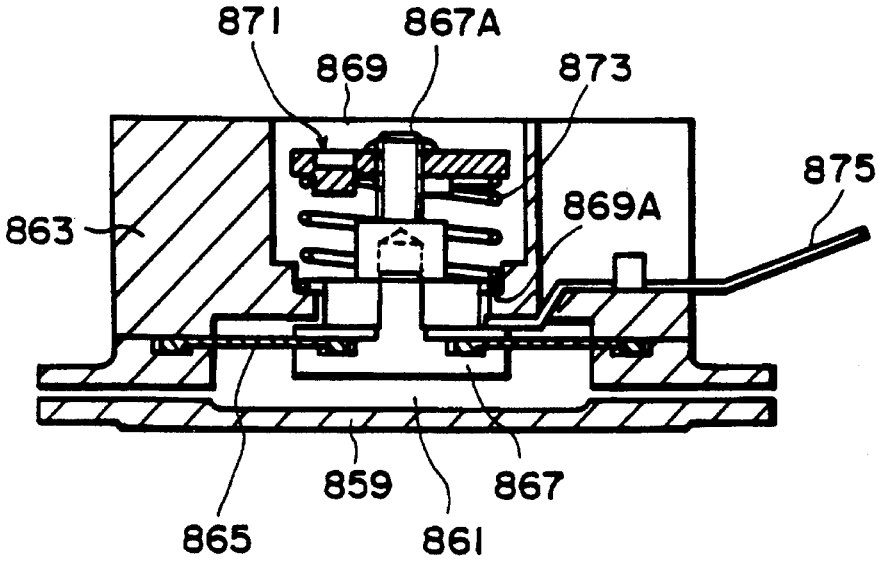
FIG. 8B PRIOR ART

FIGS. 8A and 8B are a top plan view and a longitudinal sectional view of an ink pressure detecting device (ink sensor) which does not use the present invention. It comprises a passage member 859 having an inside ink passage 861, a confining member 863. These members 859 and 863 sandwich the diaphragm 865. The central portion 867A of the supporting member 867 mounted to the center of the diaphragm 865 is projected into a through hole 869 at the center of the confining member 863. To the upper portion of the central portion 867A, a ring adjuster 891 is threaded. A spring 873 is compressed by the adjuster 871 and the annular projection 869A at the bottom of the hole 869. With the higher pressure of the ink in the ink passage 861 than a predetermined negative pressure, the diaphragm 865 and the supporting member 867 are raised by the repelling force of the spring 873, and the ends of the contacts 875 and 877 on the bottom surface of the annular projection 869A are pressed by the peripheral top portion of the supporting member 867, so that the electric connection is established therebetween. With such a structure, when the pressure of the ink in the ink passage 861 decreases beyond a predetermined negative pressure, the diaphragm 865 respond to it, so that the supporting member 867 lowers. As a result, the supporting member is away from the ends of the contacts 875 and 877, upon which the predetermined negative pressure is detected. Accordingly, the negative pressure detected by the contacts 875 and 877 corresponds to the repelling force of the spring 873.

However, in such an ink pressure detector, very cumbersome adjustment operations are required to determine the level of the negative pressure to be detected. During the assembly, the negative pressure detected is not stabilized only by compressing the spring 873 by rotating the adjuster 871. FIG. 7 shows an example of a relation between the ink remaining quantity (g) in the ink cartridge and the negative pressure of the ink in the ink passage. In order to provide the detecting negative pressure of 65±5 mm aq., the pressure of the spring 873 is very finely adjusted by the adjuster 871. This is very cumbersome.

Figure 9:
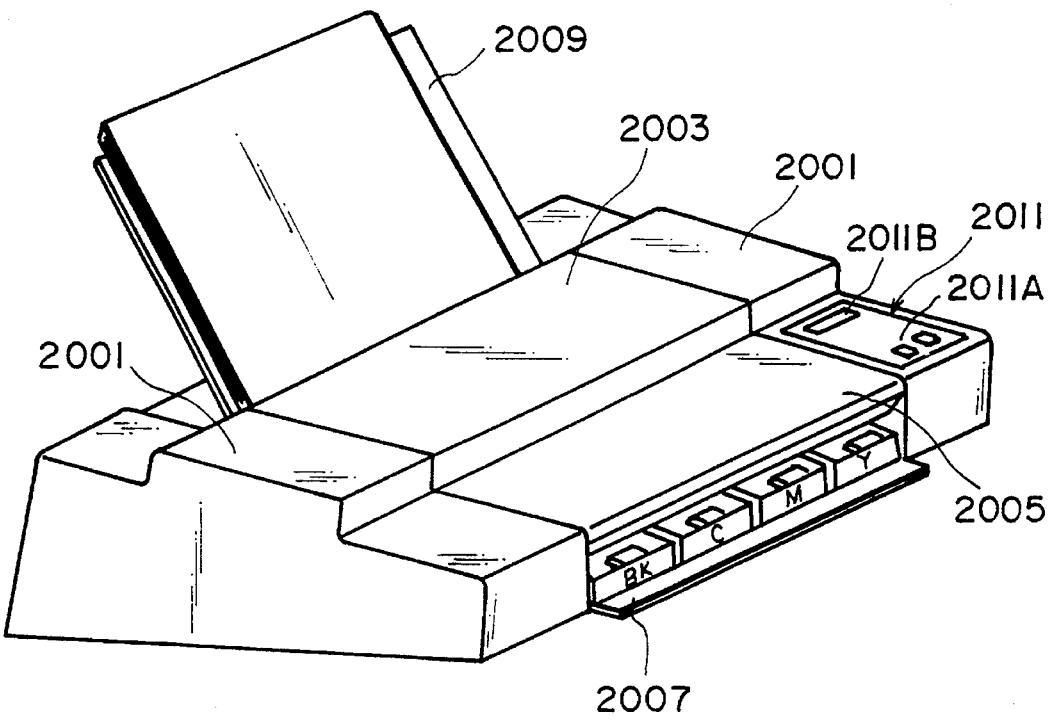
FIG. 9 is a perspective view of an ink jet recording apparatus according to a further embodiment of the present invention.
Figure 10A:
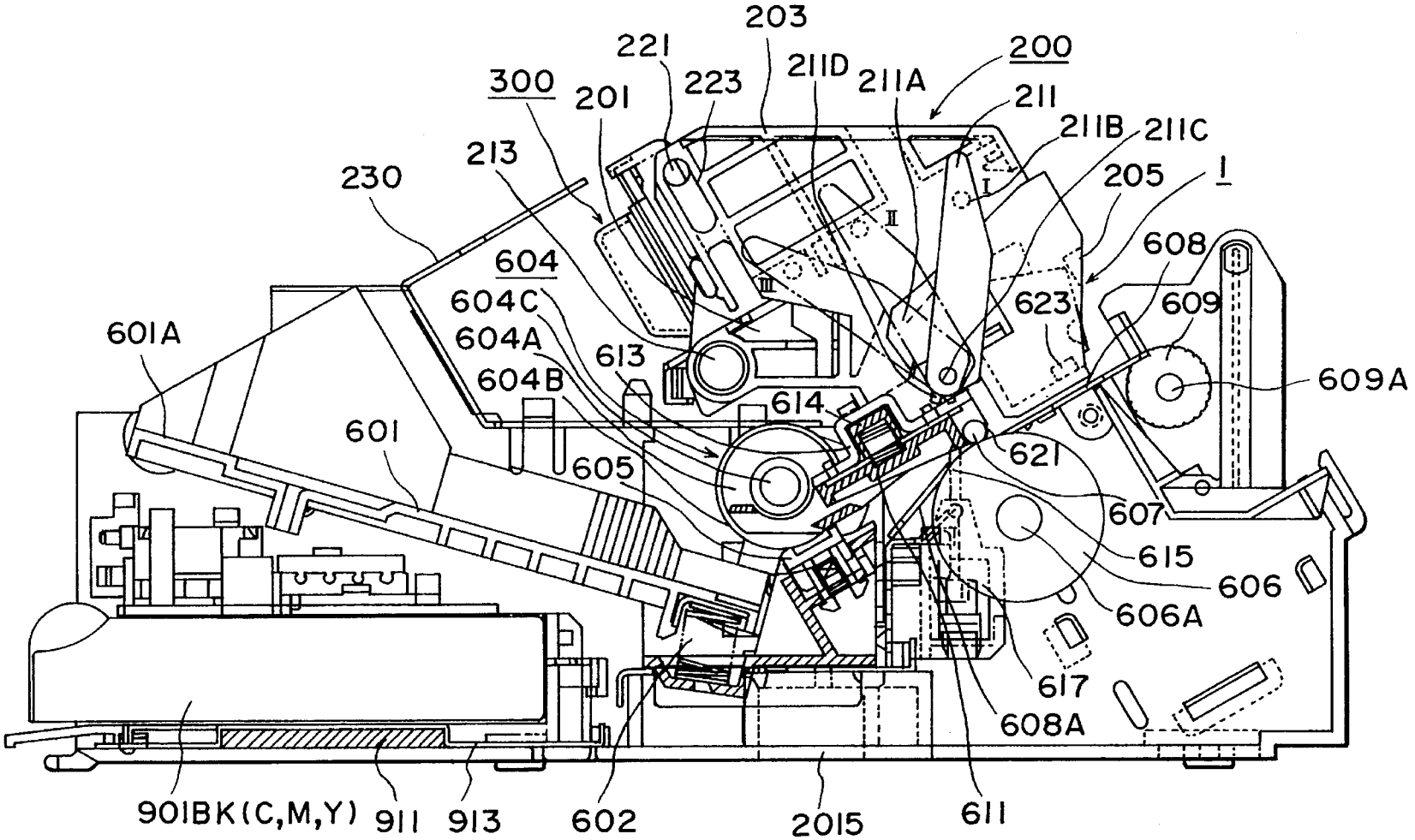
FIGS. 10A and 10B are a side view and a top plan view partly in a cross-section, of a recording apparatus shown in FIG. 1.
Figure 10B:
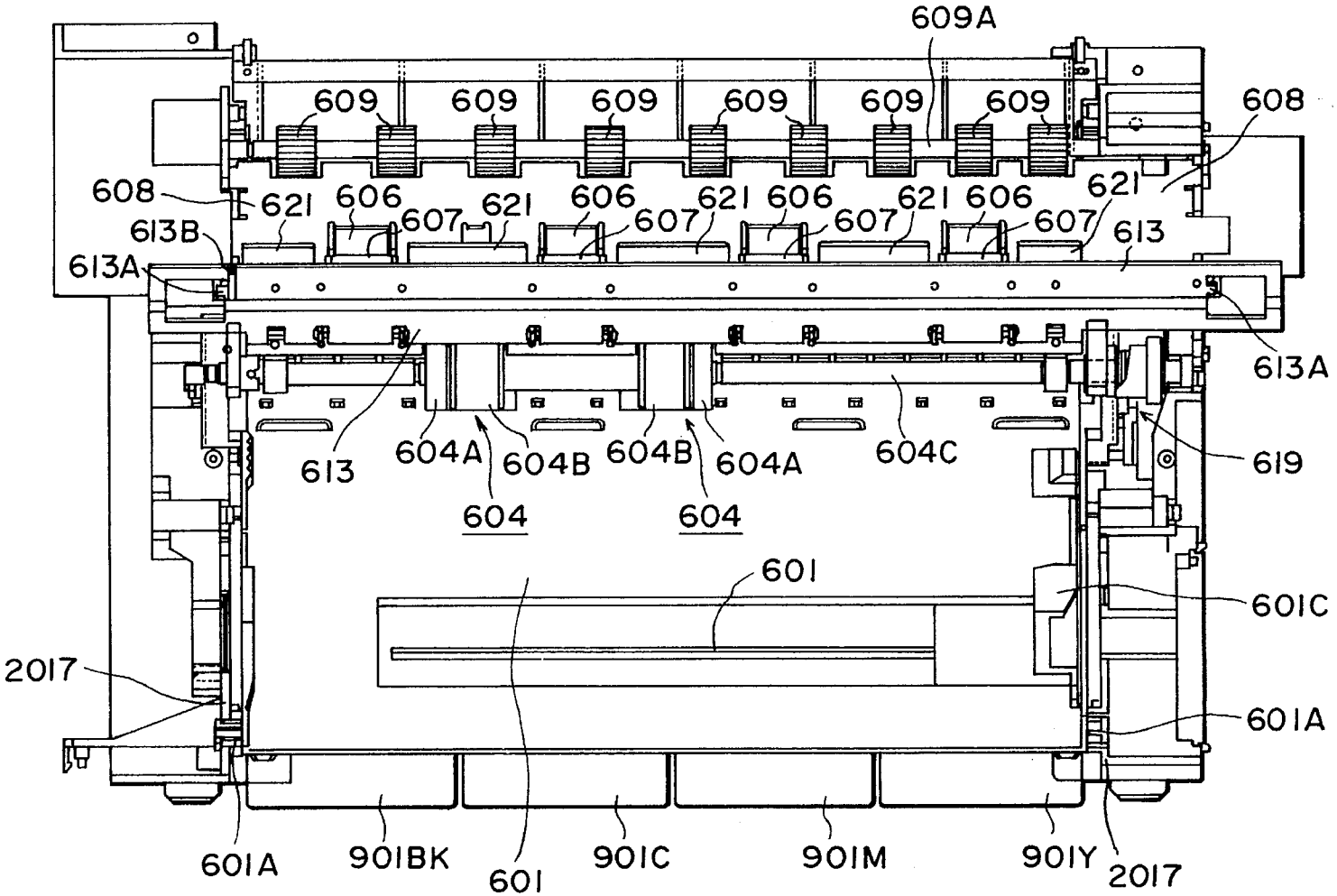

Referring to FIGS. 9, 10A and 10B, an ink jet recording apparatus having an ink cartridge mounting portion, usable with the ink cartridge having the structure described above.

FIG. 9 is an outer perspective view of an ink jet recording apparatus according to an embodiment of the present invention. It comprises a main casing 2001 constituting a part of an apparatus casing. It covers the apparatus the opposite end portions fixed to the frame of the ink jet recording apparatus, that is, except for the portion corresponding to the width of the recording material conveyed along its conveying passage. In one of the opposite end portions, a hole position for the recording head is provided. The recording head placed there during the non-recording-operation, and the ejection recovery unit for capping the ejection side of the recording head, are covered by the main casing 2001. Thus, when the apparatus is subjected to a maintenance or servicing operation with a part thereof opened, the recording head and the ejection recovery unit are prevented from access thereto. Therefore, the positions thereof are assured.

An intermediate casing 2003 constitutes another part of the apparatus casing, and it mainly covers the portion in which the recording head moves during the recording operation. The intermediate casing 2003 is easily detachable. It is provided with spurs corresponding to the discharging rollers which will be described hereinafter. The intermediate casing 2003 is effective to urge the spurs to the discharging rollers with proper pressure. A sheet feed cover 2005 constitutes another part of the apparatus casing and is openable. The cover 2005 has generally a rectangular configuration, and the opposite ends of the front side edge thereof are rotatably supported, so that the cover can be opened upwardly in the Figure. When it is opened, it is retained at a predetermined angle. When the cover 2005 is maintained at this angle, it provides substantially flat surface with the sheet feeding tray to permit the recording sheet to be placed thereon. An ink cover 2007 constitutes another part of the apparatus casing adjacent a front side of the apparatus. The ink cover 2007 is rotatably supported by a shaft at a bottom portion in the front of the apparatus. If necessary, the cover 2007 may be opened toward the operator to permit mounting and demounting of the ink cartridge.

A sheet discharge tray 2009 is detachably mountable on the apparatus. The discharge tray 2009 is mounted at a predetermined angle to a rear side of the apparatus, and the recording sheet having been subjected to the recording operation can be sequentially stacked. An operating panel 2001 is disposed at a side of the front side of the main casing 2001. The operating panel 2011 is provided with a display 2011B for displaying the conditions of the apparatus and keys 2011A for inputting the instructions.

Figure 1:
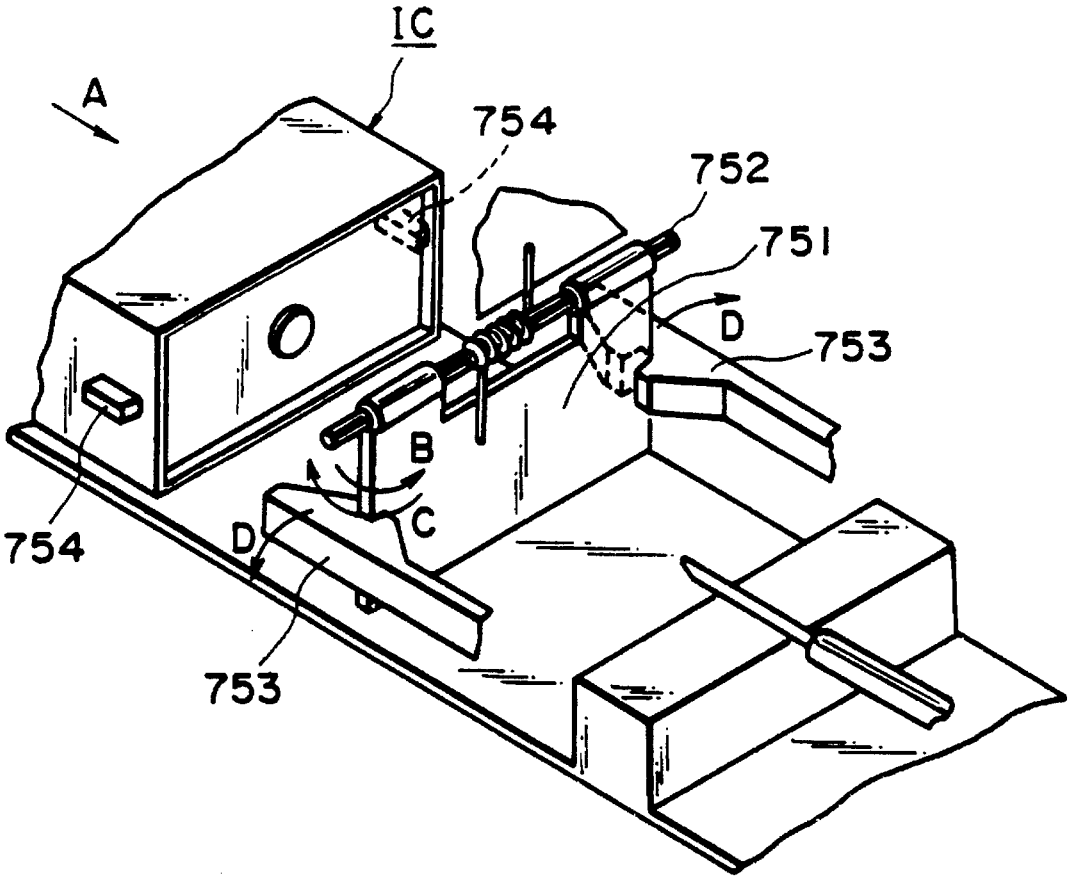
FIG. 1 PRIOR ART
FIG. 1 is a perspective view of a ink cartridge mounting portion of a conventional recording apparatus.

FIGS. 10A and 10B are a side sectional view and a top plan view of the ink jet recording apparatus of FIG. 1 without the cover. In FIG. 10B, a carriage for mounting the recording head and a driving system for the carriage are omitted.

In FIGS. 10A and 10B, a sheet feeding tray 601 constitutes a sheet feeding station together with an opened sheet feed cover 2005 as shown in FIG. 9 (not shown in FIG. 10A or 10B). The sheet feeding tray 601 is supported by a rotational shaft 601A at a rear end in the sheet feeding direction, and the shaft 601A is rotatably supported on side plates 2017 of the apparatus frame. The front end of the sheet feeding tray 601 is upwardly urged in FIG. 10A by a spring 602. The recording sheet stacked on the sheet feeding tray 601 (not shown in FIG. 10A or 10B) (the recording sheet means recording material including these made of plastic or paper) are urged by a pick-up roller 604 at the reading end. In the sheet feeding mechanism described above, a guide plate 601C functions to guide the sheets in accordance with the size thereof. The movement of the guide plate 601C in accordance with the size of the recording sheet is permitted along the groove 601D.

The pick-up roller means 604 includes a crescent roller 604A and a sheet feeding roller 604B. The crescent roller 604A, as shown in FIG. 10A, has a part-circle cross-section, and the sheet feeding roller 604B has a circular configuration having a diameter slightly smaller than the diameter of the circular portion of the crescent roller 604A. Two pairs of the pick-up roller means 604 are disposed at a predetermined interval adjacent a front end of the sheet feeding tray 601. The two pairs of the pick-up rollers 604 are fixed on a pick-up roller shaft 604C extended perpendicular to the direction of the sheet feeding direction. An end of the pickup roller shaft 604C is rotatably supported on the frame 2017, and the other end is coupled with a clutch 619. Thus, the driving force from an unshown motor is transmitted to the pick-up roller shaft 604C via clutch 619 to rotate the pick-up roller 604. The recording sheets stacked on the sheet feed tray 601 are urged by the pick-up roller means 604. When the pick-up roller means 604 rotates, the recording sheet is picked up by the connected part between the cut portion and the circular portion, and is fed out to the recording sheet passage by the cooperation between the sheet feeding roller 604B and the separating plate 605 which will be described in detail in conjunction with FIG. 12.

A sheet feeding roller 606 is disposed downstream of the pick-up roller means 604 in the recording sheet conveying passage. Four of the sheet feeding rollers 606 are disposed at the predetermined intervals in the direction of the width of the recording sheet, as shown in FIG. 10B. The four sheet feeding rollers are fixed on the sheet feeding roller shaft 606A (not shown in FIG. 10B). Therefore, the driving force from an unshown sheet feeding roller is transmitted to the sheet feeding roller shaft 606A, so that the sheet feeding roller 606 is rotated.

Pinch rollers 607 are provided corresponding to the respective sheet feeding rollers 606. The circular peripheral surfaces are contacted to the circular peripheral surfaces of the sheet feeding rollers 606. A pinch roller holder 611 is provided for each of the pinch rollers 607. It rotatably supports the pinch roller 607 at its one end. A carriage rail 613 is extended over the carriage movable range which will be described hereinafter. The pinch roller holder 611 is supported by a carriage rail 613 at its another end, and is urged in the inclined downward direction in FIG. 10 by a spring 614 supported between the carriage rail 613 and the pinch roller holder 611. Thus, the recording sheet fed to between the pinch roller 607 and the sheet feeding roller 606 is urged to the sheet feeding roller 606. The sheet feeding roller 606 feeds the recording sheet by the friction force resulting from the urging. A platen 608 is effective to confine the recording surface of the recording sheet. It is disposed downstream of the sheet feeding roller 606 or the like in the sheet feeding passage and is disposed faced to the recording head which will be described hereinafter. Downstream of the platen 608, nine discharging rollers 609 are disposed. As shown in FIG. 10B, the discharging rollers 609 are arranged at predetermined intervals in the direction of the width of the recording sheet, and they are fixed on the sheet discharging roller shaft 609A. The sheet discharging roller shaft 609A is rotated by an unshown motor, and cooperates with the spurs supported on the main casing 2001 (FIG. 9) so as to discharge the sheet to the sheet discharge tray 2009 (FIG. 9).

In the recording sheet passage described in the foregoing, the recording sheets stacked on the sheet feeding tray 601 are separated and fed one by one by the pick-up roller means 604 and the separating plate 605. The recording sheet is guided by the sheet guide 608A and is introduced to between the sheet feeding roller means 606 and the pinch roller 607. During this feeding operation, the recording sheet is contacted to an end of a sheet end detecting sensor lever 615, upon which another end of the lever 615 switches the photosensor 617, so that the end of the recording sheet can be detected. The bottom of the carriage which will be described hereinafter is provided with a reflection type sheet end sensor 623, by which the width of the recording sheet can be detected.

The sheet feeding roller 606 is effective to feed the recording sheet one line by one line on the platen 608 in accordance with the recording operation of the recording head, so that characters, images or the like are recorded on the recording sheet. During recording, the recording sheet is urged to the platen 608 by the sheet confining spring 621 so as to assure the flatness of the recording sheet in the recording region. The recording sheet now having the record thereon is discharged to the sheet discharge tray by the discharging rollers 609.

As will be understood from FIG. 10A, the recording sheet conveying passage from the sheet feed tray 601 to the sheet discharging rollers 609 further to the sheet discharging tray 2009 shown in FIG. 1 is in the form of a smooth "V" shape. Therefore, the recording sheet can be closely contacted to the platen 608 by the rigidity of the recording sheet. This further assures the flatness of the recording sheet in the recording region.

Figure 11:
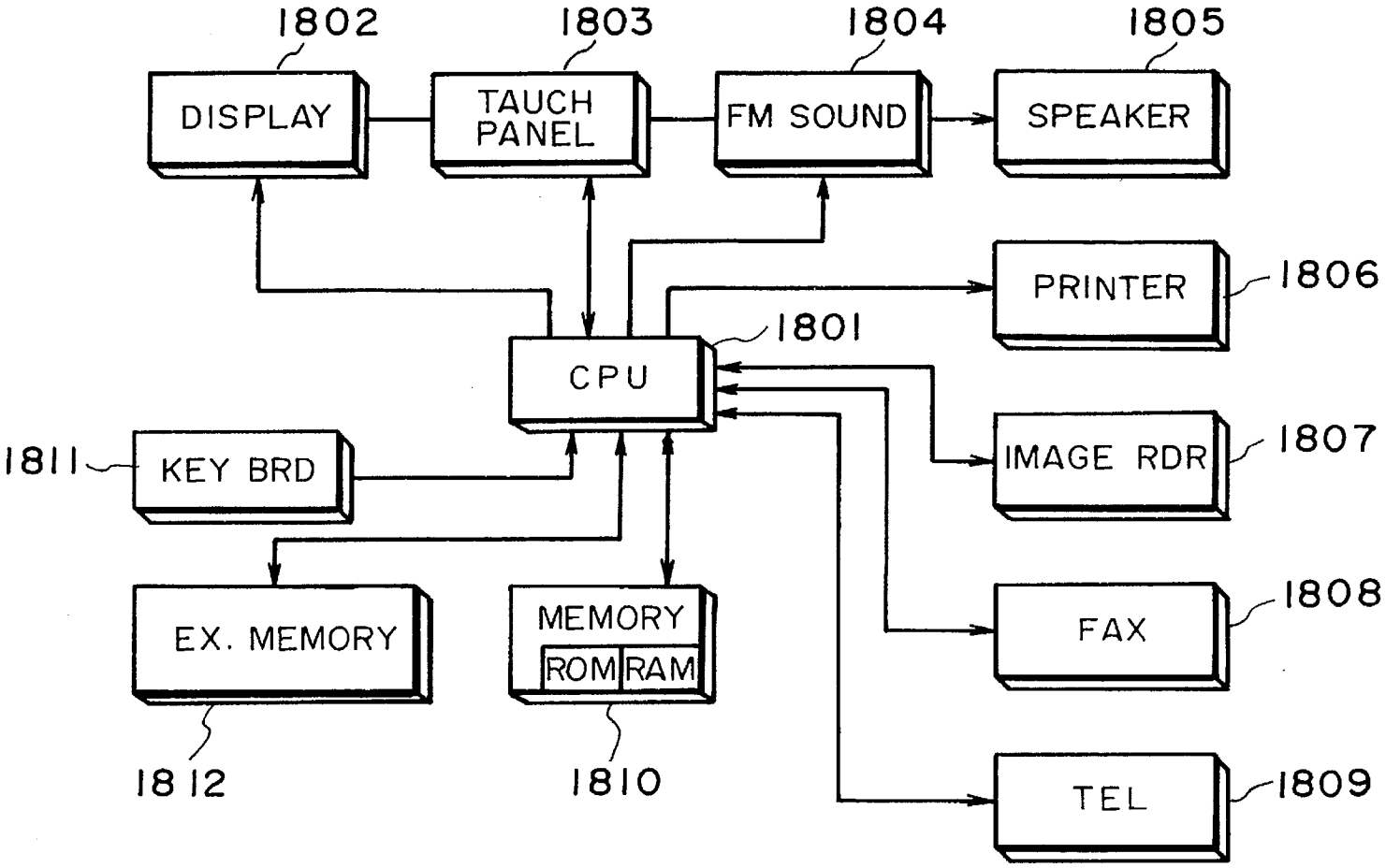
FIG. 11 is a block diagram of an information processing apparatus using the present invention.

In FIG. 10A, designated by a reference numeral 1 is a recording head. It comprises four recording chips corresponding to the colors of the ink materials, as shown in FIG. 11. The head chips are mounted on the mounting portion 201 of the carriage 200 for easy detachment. The carriage comprises a carriage cover 203 and a head cover 205. These covers are mounted on the carriage mounting portion 201, upon which the electric connections of the recording head chip and the positioning thereof are established. A subordinate ink container 300 is mounted to a part of the carriage main assembly 201. The subordinate container 300 is effective to trap bubbles in the ink supply system and to buffer the pressure variation in the supply system resulting from the carriage movement, so that the recording head is protected from the influence of the bubbles and the pressure variations. The above-described various elements mounted on the main assembly 201 of the carriage, such as the recording head or the like, are moved along the guide shaft 213 by the movement of the carriage main assembly 201 along the guide shaft 213 (only a section is shown in FIG. 10A) with which the carriage is slidably engaged. The carriage main assembly 201 is connected with a belt which is driven by an unshown motor. In FIG. 10A, a position lever 211 can be manipulated by the operator. An end thereof is rotatably supported by a shaft 211C at a part of the carriage main assembly 201. The other end of the position lever 211 is formed into a projection 211B in a part spherical shape. This is engaged with recesses formed at three positions of the side plate of the carriage 200 (not shown). Thus, the position lever 211 can take three positions selectively. When the position lever 211 is at a position I and position II, as shown in FIG. 10A, the carriage main assembly 201, and therefore, the recording head chips thereon, are shifted about the guide shaft 213, so that the positioning is established corresponding to the contact between the position lever 211 and the carriage rail 213. At the position I of the position lever 211 in FIG. 10A, a part of the carriage main assembly 201 is slidably in contact with the top surface of the carriage rail 613. At this time, the recording head chip is relatively close to the platen 608. When the position lever 211 is at the position II, the confining member 211 integral with the position lever 211 is in contact with the top surface of the carriage rail 613. At this time, the recording head chip is relatively largely away from the platen 608 by rotation about the guide shaft 213 upwardly in FIG. 10A by the contact portion.

When the ink used has a relatively poor ink absorption tendency, the lever position II is selected, so that the recording head chip is relatively largely away from the platen 608, by which the waving of the recording sheet resulting from the recording ink absorbed is prevented. If the waving occurs, the recording sheet rubs the ejection side surface of the recording head chip so as to damage it. When the ink has good absorbing property, such a consideration is not necessary, and therefore, the position lever 211 is placed at the position I.

The position III of the position lever 211 is provided to prevent the rightward movement of the carriage 200 when the carriage 200 is at the home position. As shown in FIG. 10B, the projection 211D at an end of the position lever 211 is engaged with a locking recess 613b formed adjacent the left end of the carriage rail 613, so that the rightward movement of the carriage 200 (not shown in FIG. 10B) is prevented. The current position of the position lever 211 may be displayed or the sound may be produced upon shifting. As described in the foregoing, the position lever 211 is manipulated by the operator. For example, when the carriage 200 is at the home position, the operator may starts the recording operation with the position lever 211 at the position III. In that case, the display or sound is produced to promote the operator to shift the position lever.

The current position of the position lever 211 may be displayed for the three positions.

When the apparatus is subjected to vibration beyond a predetermined degree during the carrying of the apparatus or the like, the position of the position lever is detected, and if it is not at the position III, that is, the position for fixing the carriage, the sound or the like may be produced.

With this structure for preventing the movement of the carriage, the apparatus can be protected from the movement of the recording head I and the resultant damage thereof or another part during the recording apparatus carrying, can be prevented. In FIG. 10A, a cover 230 is fixed on the apparatus frame, and protects the ink supply tube and the flexible cable or the like following the carriage 200 during its movement.

In FIGS. 10A and 10B, references 901BK, 901C, 901M and 901Y are ink cartridges mounted in the ink supply unit which will be described hereinafter. They contain black ink, cyan ink, magenta ink and yellow ink respectively in the respective bladder. They are also provided with residual ink bladder for the respective color for receiving the ink discharged by the ejection recovery operation or the like. Below the ink supply unit for mounting the the ink cartridge, an ink absorber 911 is disposed. The ink absorber 911 is made of such a material that the configuration restores after removal of external force. It is compressed between a recess of a frame 913 constituting the supply unit and a bottom plate 2015 of the apparatus frame. Therefore, even if the ink is leaked from the ink cartridge 901, it can be absorbed by the absorbing material 911. The vibration resulting from the driving motor transmitted via the bottom plate 2015 or the like can be absorbed by the absorbing material 911, so that the influence of the vibration can be reduced.

The absorbing material for the vibration absorption is not required to be disposed below the ink supply unit as described above, but it may be disposed at a place effective to reduce the apparatus noise.

The present invention is particularly suitably usable in an ink jet recording head and recording apparatus wherein thermal energy by an electrothermal transducer, laser beam or the like is used to cause a change of state of the ink to eject or discharge the ink. This is because the high density of the picture elements and the high resolution of the recording are possible.

The typical structure and the operational principle are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from the nucleate boiling point, by which the thermal energy is provided by the electrothermal transducer to produce film boiling on the heating portion of the recording head, whereby a bubble can be formed in the liquid (ink) corresponding to each of the driving signals. By the production, development and contraction of the the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the above-mentioned patents. In addition, the present invention is applicable to the structure disclosed in Japanese Laid-Open Patent Application No. 123670/1984 wherein a common slit is used as the ejection outlet for plural electrothermal transducers, and to the structure disclosed in Japanese Laid-Open Patent Application No. 138461/1984 wherein an opening for absorbing pressure wave of the thermal energy is formed corresponding to the ejecting portion. This is because the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head and plural recording head combined to cover the maximum width.

In addition, the present invention is applicable to a serial type recording head wherein the recording head is fixed on the main assembly, to a replaceable chip type recording head which is connected electrically with the main apparatus and can be supplied with the ink when it is mounted in the main assembly, or to a cartridge type recording head having an integral ink container.

The provision of the recovery means and/or the auxiliary means for the preliminary operation are preferable, because they can further stabilize the effects of the present invention. As for such means, there are capping means for the recording head, cleaning means therefor, pressing or sucking means, preliminary heating means which may be the electrothermal transducer, an additional heating element or a combination thereof. Also, means for effecting preliminary ejection (not for the recording operation) can stabilize the recording operation.

As regards the variation of the recording head mountable, it may be a single corresponding to a single color ink, or may be plural corresponding to the plurality of ink materials having different recording color or density. The present invention is effectively applicable to an apparatus having at least one of a monochromatic mode mainly with black, a multi-color mode with different color ink materials and/or a full-color mode using the mixture of the colors, which may be an integrally formed recording unit or a combination of plural recording heads.

Furthermore, in the foregoing embodiment, the ink has been liquid. It may be, however, an ink material which is solidified below room temperature but liquefied at room temperature. Since the ink is controlled within the temperature not lower than 30° C. and not higher than 70° C. to stabilize the viscosity of the ink to provide the stabilized ejection in usual recording apparatus of this type, the ink may be such that it is liquid within the temperature range when the recording signal is the present invention is applicable to other types of ink. In one of them, the temperature rise due to the thermal energy is positively prevented by consuming it for the state change of the ink from the solid state to the liquid state. Another ink material is solidified when it is left, to prevent the evaporation of the ink. In either of the cases, the application of the recording signal producing thermal energy, the ink is liquefied, and the liquefied ink may be ejected. Another ink material may start to be solidified at the time when it reaches the recording material. The present invention is also applicable to such an ink material as is liquefied by the application of the thermal energy. Such an ink material may be retained as a liquid or solid material in through holes or recesses formed in a porous sheet as disclosed in Japanese Laid-Open Patent Application No. 56847/1979 and Japanese Laid-Open Patent Application No. 71260/1985. The sheet is faced to the electrothermal transducers. The most effective one for the ink materials described above is the film boiling system.

The ink jet recording apparatus may be used as an output terminal of an information processing apparatus such as computer or the like, as a copying apparatus combined with an image reader or the like, or as a facsimile machine having information sending and receiving functions.

FIG. 11 is a block diagram when the recording apparatus of the present invention is used with an information processing apparatus having a word processor function, a personal computer function, a facsimile machine function and a copying machine function.

A control system 1801 for the entire apparatus includes a microprocessor or another CPU and various I/O ports to supply control signals and data signals to various parts and to receive various control signals and data signals from various parts. A display 1802 displays various menus, document information, image data read by an image reader 1807, or the like. A pressure sensitive touch panel 1803 is provided on the display 1802 and is made of transparent material. When a part of the surface thereof is depressed by a finger or the like, the item on the display 1802 can be selected, and the coordinate position can be selected.

An FM (frequency modulation) sound source 1804 stores in the form of digital data in an external memory device 1812 or in a memory 1810 musical information produced by a music editor or the like. It reads out of the memory and effects FM modulation. The electric signals from the FM sound source 1804 are converted to human sensitive sound by a speaker 1805. The printer 1806 is provided for an output terminal for the word processor function, the personal computer function, the facsimile machine function and the copying machine function.

An image reader 1807 functions to read photoelectrically original data, and is disposed halfway of the original. It reads the original for the facsimile function and the copying machine function. A facsimile sender-receiver 1808 functions to send original data read by the image reader 1807 and to receive facsimile signals send thereto and decode the facsimile signals. It has an interface with the external thereof. A telephone function 1809 is provided with usual or additional telephone facilities.

Memory 1810 includes a ROM for storing a system program, a manager program, another application program, character font, dictionary or the like, and a RAM storing application program loaded from an external memory device 1812, document information, video signals or the like.

A keyboard 1811 functions to input document information and various commands or the like.

In an external memory device 1812 in the form of a floppy disk or a hard disk, document information, music information, sound information, users application program or the like are stored.

Figure 12:
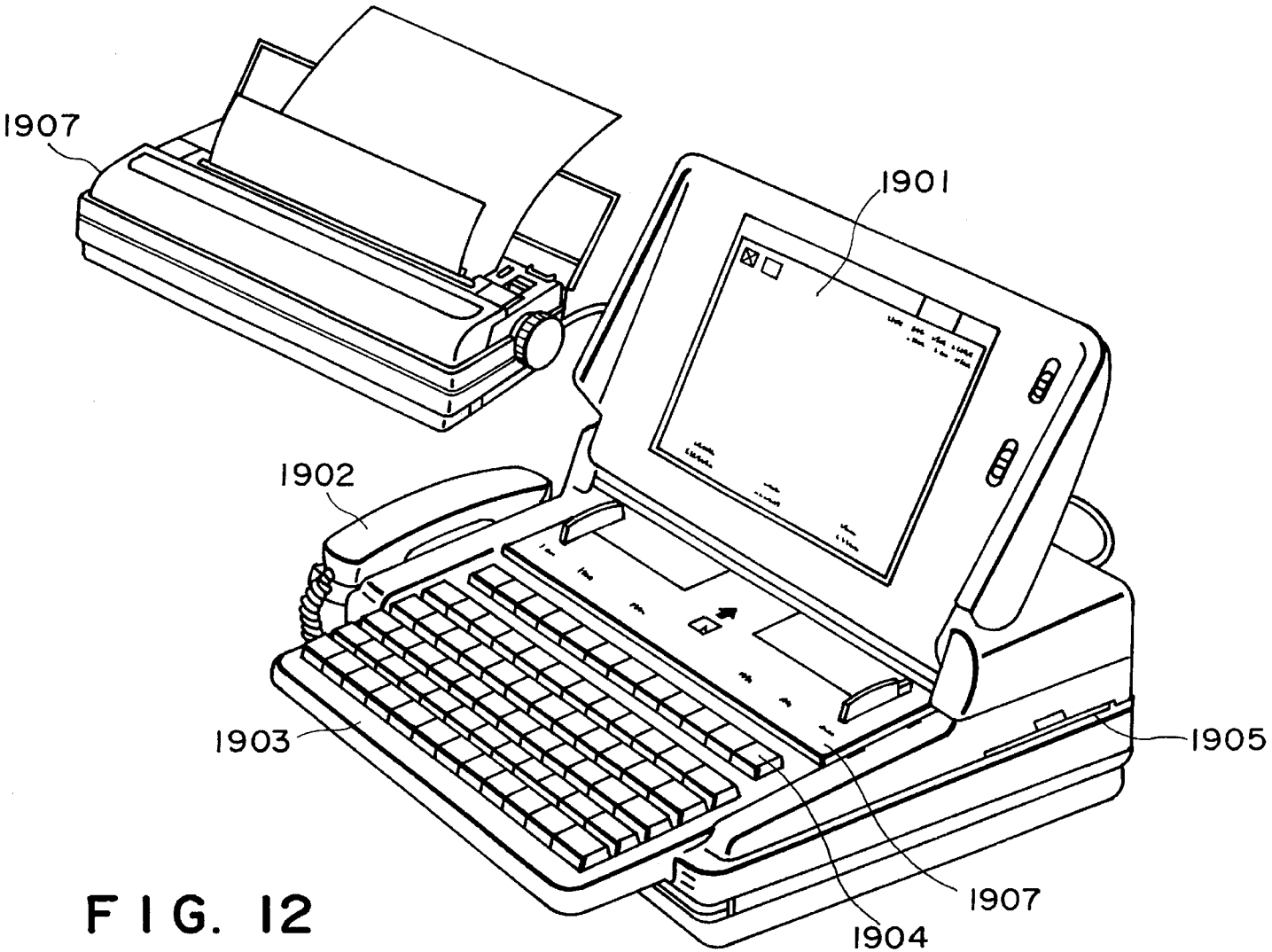
FIG. 12 is a perspective view of the information processing apparatus of FIG. 11.

FIG. 12 shows an outer appearance of information processing device shown in FIG. 11. A flat panel display 1901 using liquid crystal or the like functions to display various menus, figure information and document information or the like. On the display 1901, a touch panel 1803 is mounted. By depressing a part of the surface of the touch panel 1803 by a finger or the like, an item or coordinate position can be selected. A hand set 1902 is used when the apparatus is used as a telephone set. A keyboard 1903 is detachably connected with the main assembly by a cable to permit input of various document information and various data. The keyboard 1903 is provided with various function keys 1904 or the like. The floppy disk is set through a port 1905.

An image reader 1807 has an original mounting portion 1906. The original read thereby is discharged at the rear end of the apparatus. During the facsimile reception, the information is recorded by the ink jet printer 1907 according to the present invention.

The display 1802 may use CRT, but a flat panel of ferroelectric liquid crystal, since then the size, thickness and the weight thereof can be reduced.

When the information processing device is used as the personal computer or the word processor, the various information supplied from the keyboard 211 is processed in accordance with a predetermined program by the controller 1801, and is outputted as an image by the printer 1806.

When it is used as a copying machine, the original is read by the image reader 1807, and the original data read is outputted as a copy image by the printer 1806 through the controller 1801. When it functions as a sender of the facsimile machine, the original image data read by the image reader 1807 is processed by the controller 1801 in accordance with a predetermined problem, and is transmitted to the communication line through the facsimile sender-receiver 1808.

Figure 13:
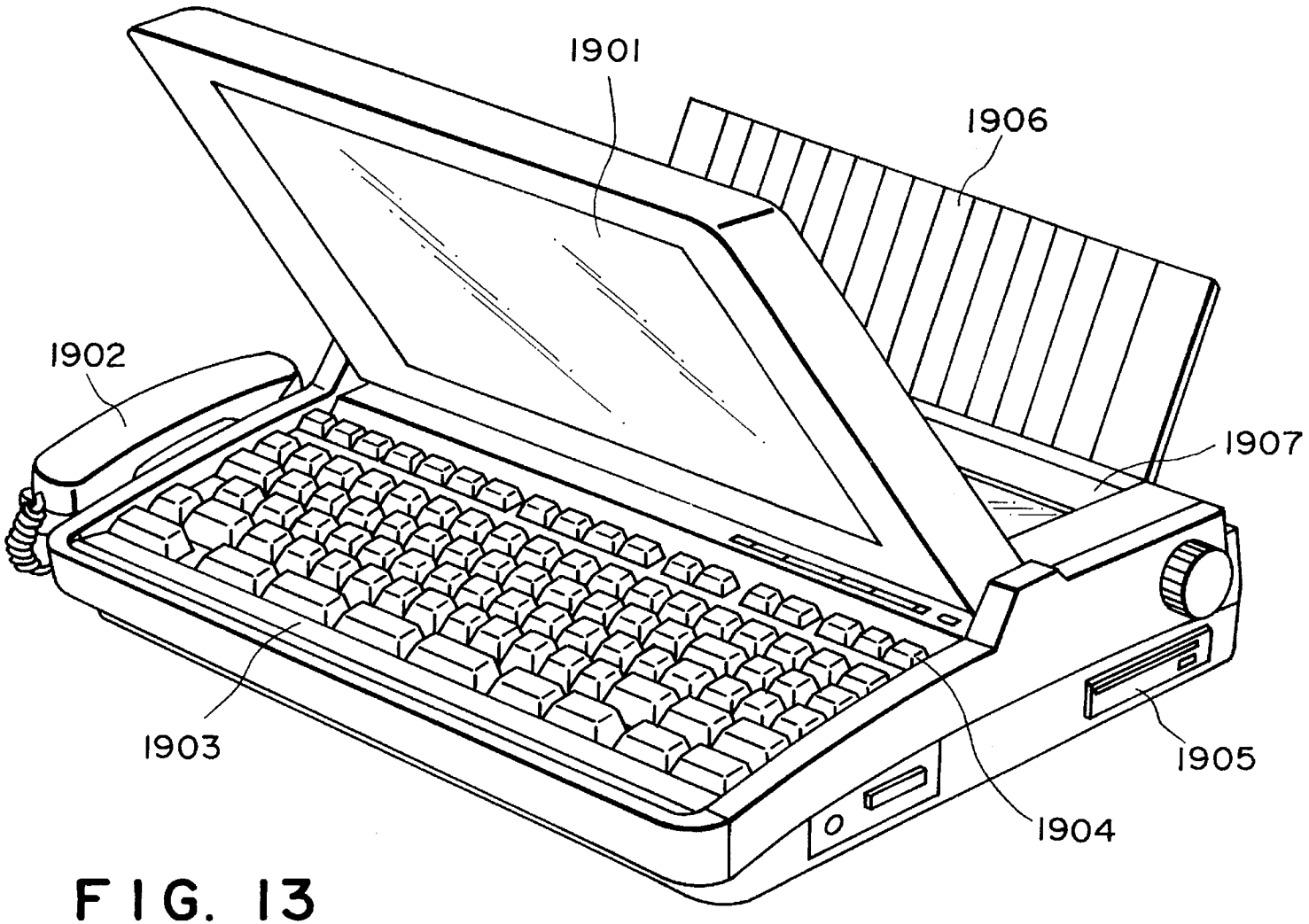
FIG. 13 is a perspective view of a unified information processing apparatus.

As shown in FIG. 13, the information processing apparatus may have an integral ink jet printer. In this case, the apparatus is easily carried around. In the Figure, the same reference numerals as in FIG. 12 are assigned to the elements having the corresponding functions.

A high quality recording is possible at high speed and with less noise, and therefore, the functions of the above-described information processing apparatus can be further enhanced, when it is used with the recording apparatus according to the present invention.

As described in the foregoing, according to the present invention, the protection member can be easily released using the front portion of an ink cartridge. The positional relations as described in the foregoing among the cut-away portions of the ink cartridge, the ink supplying portion, the ink cartridge information presenting portion relative to the position index member, the ink supply communicating means and the reading means of the main assembly, assure the mounting of the ink cartridge, thus assuring the supply of the ink.

The cut-away portions are different depending on the color of the ink contained in the cartridge, and correspondingly, the index member of the recording apparatus is made different depending on the color of the ink. Therefore, the erroneous loading of the ink cartridge can be prevented.

According to an embodiment of the present invention, the ink jet recording apparatus can automatically select the ink jet head driving conditions in accordance with the property and the color of the ink in the ink cartridge.

According to an embodiment of the present invention, the remaining quantity of the ink in the ink cartridge can be detected by an ink pressure detecting device which can be easily assembled, and a cumbersome adjustment operation during the assembling is not necessary.

While the invention has been described with reference to the structures disclosed herein, it is not confined to the details set forth and this application is intended to cover such modifications or changes as may come within the purposes of the improvements or the scope of the following claims.

What is claimed is:

1. An ink jet recording apparatus usable with an ink cartridge, the apparatus comprising:

a mounting portion for detachably mounting an ink cartridge containing ink when the ink cartridge is inserted into said mounting portion in a mounting direction;

an openable blocking plate for blocking an ink cartridge mounting passage extending to said mounting portion, said blocking plate being rotatable about a blocking plate axis and having a width region in a direction along the blocking plate axis; and a limiting member rotatable about a limiting member axis substantially parallel with the mounting direction and having an engaging portion engaged with said blocking plate when the ink cartridge is not mounted and an inclined surface portion contactable with a front portion of the ink cartridge upon insertion thereof into the mounting passage, wherein said limiting member is within said width region and is inclined relative to a plane normal to said blocking plate axis for rotation about said limiting member axis by contact between said inclined surface portion and the front portion of the ink cartridge.

2. An apparatus according to claim 1, wherein said limiting member is generally triangular forming a predetermined angle relative to a direction of insertion of the ink cartridge, and a part thereof is cut away to receive said blocking plate.

3. An apparatus according to claim 1, wherein said limiting member is contacted by the ink cartridge to release said blocking plate, wherein said blocking plate is contacted by the ink cartridge and is rotated upwardly by further insertion of the ink cartridge.

4. An apparatus according to claim 1, wherein said limiting member forms an angle not less than 45 degrees relative to a line normal to the mounting passage.

5. An apparatus according to claim 1, wherein said blocking plate rotates upwardly by movement of the ink cartridge in the mounting passage.

6. An apparatus according to claim 1, further comprising in addition to said mounting portion at least one additional mounting portion, wherein each said mounting portion is disposed for mounting an ink cartridge containing a different ink.

* * * * *

UNITED STATES PATENT AND TRADEMARK OFFICE

CERTIFICATE OF CORRECTION

PATENT NO. : 5,504,512

DATED : April 2, 1996

INVENTOR(S) : JUNJI SHIMODA ET AL.

It is certified that error appears in the above-indentified patent and that said Letters Patent is hereby corrected as shown below:

ON COVER PAGE

At [57] Abstract:

Line 2, "passage" should read --passage,--.
Line 3, "and;" should read --and--.
Line 8, "to" should be deleted.

IN THE DRAWINGS

At Sheet 13 of 16:

Figure 11, "TAUCH" should read --TOUCH--.

COLUMN 2

Line 15, "must" should read --must be--.

COLUMN 3

Line 62, "a ink" should read --an ink--.

COLUMN 4

Line 10, "shows" should read --show--.

UNITED STATES PATENT AND TRADEMARK OFFICE

CERTIFICATE OF CORRECTION

PATENT NO. : 5,504,512

DATED : April 2, 1996

INVENTOR(S) : JUNJI SHIMODA ET AL.

It is certified that error appears in the above-indentified patent and that said Letters Patent is hereby corrected as shown below:

COLUMN 5

Line 59, "an" should read --a--.

COLUMN 6

Line 19, "in advertently" should read --inadvertently--.

COLUMN 7

Line 52, "limiting." should read --limited.--

COLUMN 8

Line 9, "this" should read --these--.

COLUMN 9

Figure 14A:
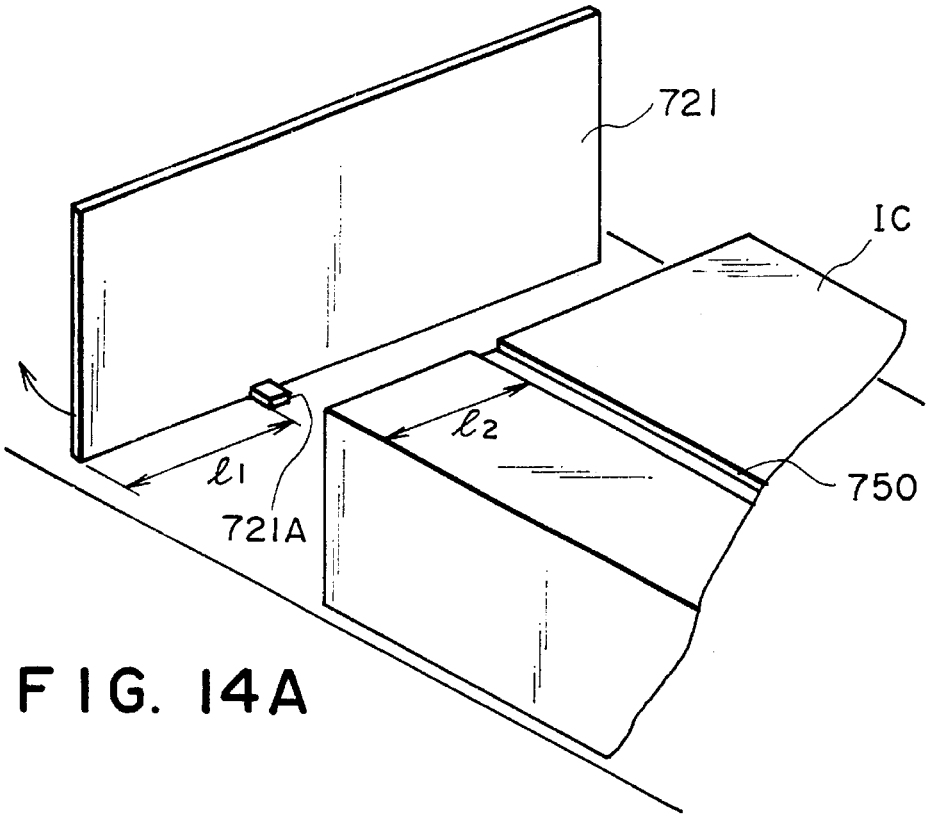
FIGS. 14A, 14B and 14C show another example of the cartridge.
Figure 14B:
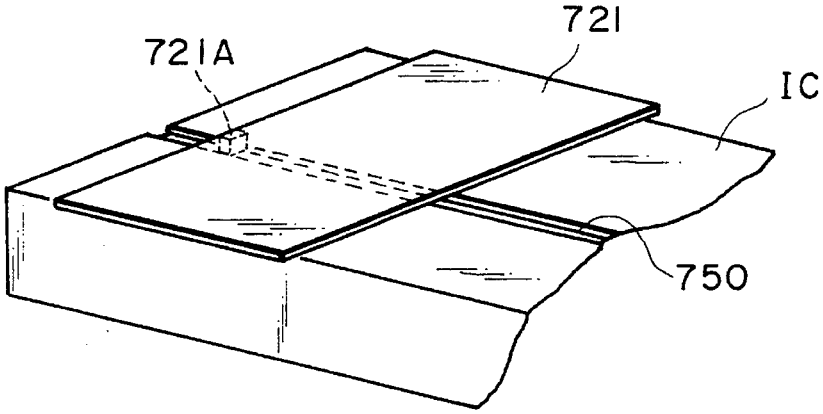
Figure 14C:
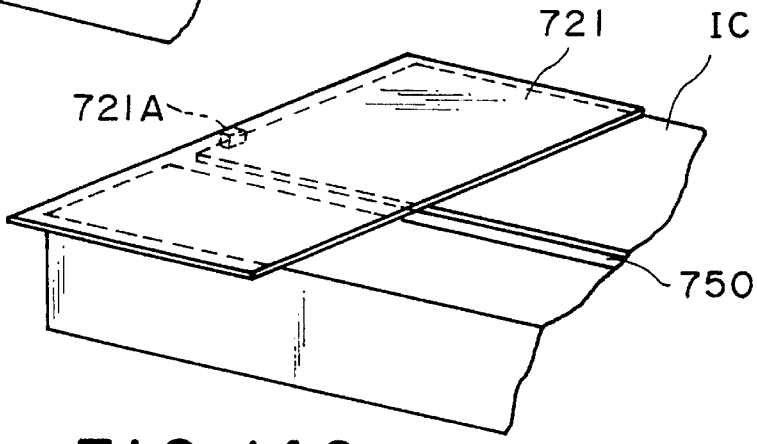

Line 16, "FIG. 14," should read --FIGS. 14A, 14B and 14C,--.

COLUMN 10

Line 27, "constitute" should read --constituted--.
Line 58, "portion" should read --portions--.

COLUMN 11

Line 53, "the" should read --toward the--.

UNITED STATES PATENT AND TRADEMARK OFFICE

CERTIFICATE OF CORRECTION

PATENT NO. : 5,504,512

DATED : April 2, 1996

INVENTOR(S) : JUNJI SHIMODA ET AL.

It is certified that error appears in the above-indentified patent and that said Letters Patent is hereby corrected as shown below:

COLUMN 12

Line 39, "respond" should read --responds--
Line 59, "above." should read --above, will be described.--.

COLUMN 19

Line 5, "send" should read --sent--.

Signed and Sealed this

Twenty-sixth Day of November 1996

*Attest:*

Bruce Lehman

BRUCE LEHMAN

*Attesting Officer*

*Commissioner of Patents and Trademarks*